US007970298B2

(12) United States Patent
Nishikawa

(10) Patent No.: US 7,970,298 B2
(45) Date of Patent: Jun. 28, 2011

(54) IMAGE FORMING APPARATUS WITH A CONTROL FOR PREVENTING A REDUCTION IN ACCURACY OF DETECTING A TONER IMAGE

(75) Inventor: Akihiro Nishikawa, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 85 days.

(21) Appl. No.: 12/437,158

(22) Filed: May 7, 2009

(65) Prior Publication Data

US 2009/0285589 A1 Nov. 19, 2009

(30) Foreign Application Priority Data

May 13, 2008 (JP) ..... 2008-125621
May 13, 2008 (JP) ..... 2008-125622

(51) Int. Cl.
*G03G 15/00* (2006.01)

(52) U.S. Cl. ..... 399/43; 399/47

(58) Field of Classification Search ..... 399/38, 399/39, 43, 49, 58–62, 47
See application file for complete search history.

(56) References Cited

U.S. PATENT DOCUMENTS

| | | | | |
|---|---|---|---|---|
| 6,832,060 | B2 * | 12/2004 | Tanaka et al. | 399/66 |
| 7,251,430 | B2 | 7/2007 | Nishikawa | |
| 7,272,331 | B2 * | 9/2007 | Kobayashi et al. | 399/44 |
| 7,379,686 | B2 | 5/2008 | Nishikawa | |
| 7,395,004 | B2 | 7/2008 | Nishikawa | |
| 7,496,305 | B2 * | 2/2009 | Watanabe | 399/61 |
| 7,512,348 | B2 * | 3/2009 | Suzuki et al. | 399/27 |
| 2007/0286621 | A1 | 12/2007 | Nishikawa | |
| 2008/0267652 | A1 | 10/2008 | Nishikawa | |

FOREIGN PATENT DOCUMENTS

| | | |
|---|---|---|
| JP | 10-149033 | 6/1998 |
| JP | 11-52637 | 2/1999 |
| JP | 2000-81739 | 3/2000 |
| JP | 2000-162836 | 6/2000 |
| JP | 2002-207403 | 7/2002 |
| JP | 2003-241470 | 8/2003 |

* cited by examiner

*Primary Examiner* — Hoan Tran
(74) *Attorney, Agent, or Firm* — Fitzpatrick, Cella, Harper & Scinto

(57) ABSTRACT

An image forming apparatus includes an image bearing member for bearing a toner image; toner image forming means for forming a toner image on the image bearing member; a detecting member for directing light to an object and for detecting the light reflected by the object; a controller for controlling a toner image forming condition of the toner image forming means in accordance with an output of the detecting member with respect to the toner image formed on the image bearing member and an output of the detecting member with respect to the image bearing member; a cleaning member, in contact to the image bearing member, for cleaning the image bearing member; an executing portion for executing, when the output with respect to the image bearing member reaches a reference level, an operation in a cleaning mode in which the cleaning member cleans the image bearing member; and a change portion for changing the reference level in accordance with a use amount of the image bearing member.

13 Claims, 11 Drawing Sheets

IMAGE FORMING APPARATUS WITH A CONTROL FOR PREVENTING A REDUCTION IN ACCURACY OF DETECTING A TONER IMAGE

FIELD OF THE INVENTION AND RELATED ART

The present invention relates to an image forming apparatus which detects a toner image, with the use of a detecting member which projects light toward an image bearing member and detects the light as the light is reflected by the image bearing member. More specifically, it relates to a control for preventing a reduction in accuracy of the detecting member.

An image forming apparatus that sequentially transfers in layers (primary transfer) multiple monochromatic toner images, different in color, onto an intermediary transfer medium, and then, transfers all at once (secondary transfer) the multiple toner images from the intermediary transfer medium onto a recording medium, in its secondary transfer station, has been put to practical use.

Japanese Laid-open Patent Application 2003-241470 discloses an image forming apparatus which causes its intermediary transfer member to bear a toner image developed with a developer which contains an external additive (additives), and then, detects the toner image on the intermediary transfer member. In the case of this image forming apparatus, the results of the detection of the toner image by the detecting member are used (fed back) to adjust the image formation conditions and image writing timing of the image forming apparatus. However, this image forming apparatus suffers from the following problem: As the intermediary transfer member of the image forming apparatus increases in the cumulative amount of usage (number of times used for image formation), it reduces in glossiness. As the intermediary transfer medium of the image forming apparatus reduces in glossiness, the optical sensor of image forming apparatus reduces in the accuracy with which it detects a toner image. That is, as the intermediary transfer member reduces in glossiness, the difference in glossiness between a toner image and the intermediary transfer member, more specifically, the ratio between the amount by which light is reflected by the toner image, and the amount by which light is reflected by the intermediary transfer member, reduces.

Therefore, it has been proposed to provide an image forming apparatus with such a cleaning mode that the amount of light projected upon the image bearing member of the image forming apparatus by the detecting member of the image forming apparatus, reflected by the image bearing member, and received by the detecting member, reaches a reference value (restoration threshold value), the image bearing member is restored in glossiness to a reference value (target restoration value), with the use of the cleaning member (fiber-based cleaning apparatus) disclosed in Japanese Laid-open Patent Application H10-149033.

However, in order to operate the image forming apparatus in the cleaning mode, the ongoing image forming operation has to be interrupted. Therefore, the frequency with which the image forming apparatus is operated in the cleaning mode is desired to be as small as possible, and further, the length of time for the cleaning mode is desired to be made as short as possible per operation.

Thus, if the reference value for starting to operate an image forming apparatus in the cleaning mode, and the reference value for stopping the image forming apparatus operation in the cleaning mode, are not changed at all, the following problem occurs:

(1) The amount by which the intermediary transfer member is contaminated before the image forming apparatus begins to be operated in the cleaning mode while the intermediary transfer member is relatively high in glossiness, is excessive; and (2) As the intermediary transfer member increases in cumulative amount of usage, the frequency with which the image forming apparatus is operated in the cleaning mode also increases, and therefore, the image forming apparatus increases in downtime. Further, it becomes impossible for the intermediary transfer member to be restored in glossiness to the reference value no matter how many times the image forming apparatus is operated in the cleaning mode, and therefore, the service life of the intermediary transfer member is reduced.

SUMMARY OF THE INVENTION

Thus, the primary object of the present invention is to provide an image forming apparatus, which is significantly less in the frequency with which it must be operated in the cleaning mode, and also, significantly less in the length of time it must be operated in the cleaning mode per cleaning operation, being therefore significantly shorter in the downtime attributable to the operation for cleaning the intermediary transfer member, than a conventional image forming apparatus.

According to an aspect of the present invention, there is provided an image forming apparatus comprising an image bearing member for bearing a toner image; toner image forming means for forming a toner image on said image bearing member; a detecting member for directing light to an object and for detecting the light reflected by the object; a controller for controlling a toner image forming condition of said toner image forming means in accordance with an output of said detecting member with respect to the toner image formed on said image bearing member and an output of said detecting member with respect to said image bearing member; a cleaning member, in contact with said image bearing member, for cleaning said image bearing member; an executing portion for executing, when the output with respect to said image bearing member reaches a reference level, an operation in a cleaning mode in which said cleaning member cleans said image bearing member; and a change portion for changing the reference level in accordance with a use amount of said image bearing member.

According to another aspect of the present invention, there is provided an image forming apparatus comprising an image bearing member for bearing a toner image; toner image forming means for forming a toner image on said image bearing member; a detecting member for directing light to an object and for detecting the light reflected by the object; a controller for controlling a toner image forming condition of said toner image forming means in accordance with an output of said detecting member with respect to the toner image formed on said image bearing member and an output of said detecting member with respect to said image bearing member; a cleaning member, in contact with said image bearing member, for cleaning said image bearing member; an executing portion for executing, when the output with respect to said image bearing member reaches a reference level, an operation in a cleaning mode in which said cleaning member cleans said image bearing member; and a change portion for changing the reference level in accordance with a use amount of said image bearing member.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the several preferred embodiments of the present invention will be described in detail with reference to the appended drawings. The present invention can also be embodied in the form of an image forming apparatus, which is partially or entirely different in structure from the image forming apparatuses in the preferred embodiments of the present invention, which will be described next, provided that the image forming apparatus is structured so that as its intermediary transfer member or the like reduces in glossiness below a certain value, the apparatus automatically begins to be operated in the glossiness restoration mode.

In the following portions of this specification, only the portions of the image forming apparatus, which are related to the formation and transfer of a toner image, will be described. However, the portions which will be described next can be used as parts of various image forming apparatuses, for example, printers, copying machines, facsimile machines, multifunction apparatuses, with the addition of devices, equipment, and housing, which are necessary for the formation of the above-mentioned apparatuses.

Further, the general features of the image forming apparatuses other than those related to the present invention, in the above-discussed two Japanese Patent Documents, will not be illustrated, and will not be described.

Embodiment 1

Figure 1:
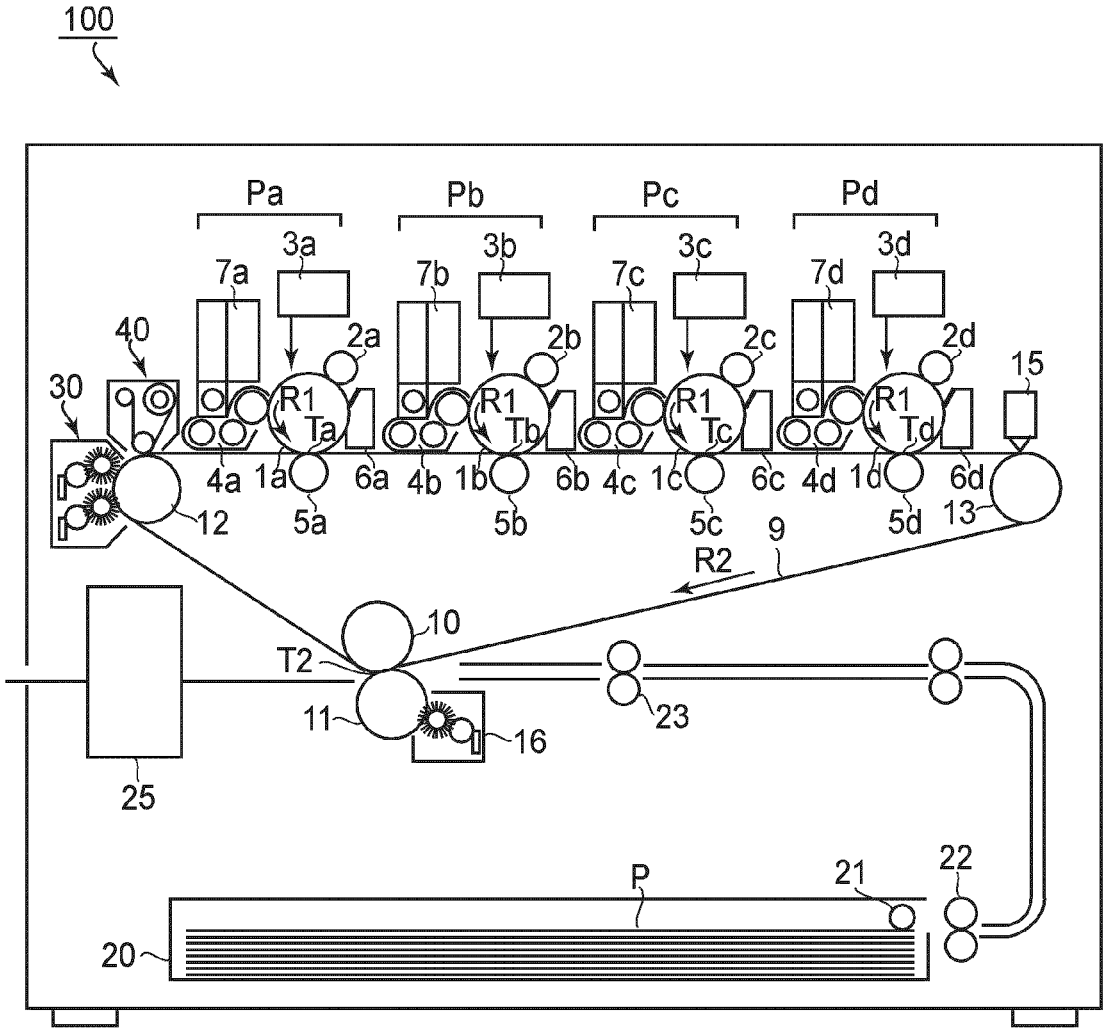
FIG. 1 is a schematic sectional view of the image forming apparatus according to a first preferred embodiment of the present invention, and depicts the general structure of the apparatus.
Figure 2:
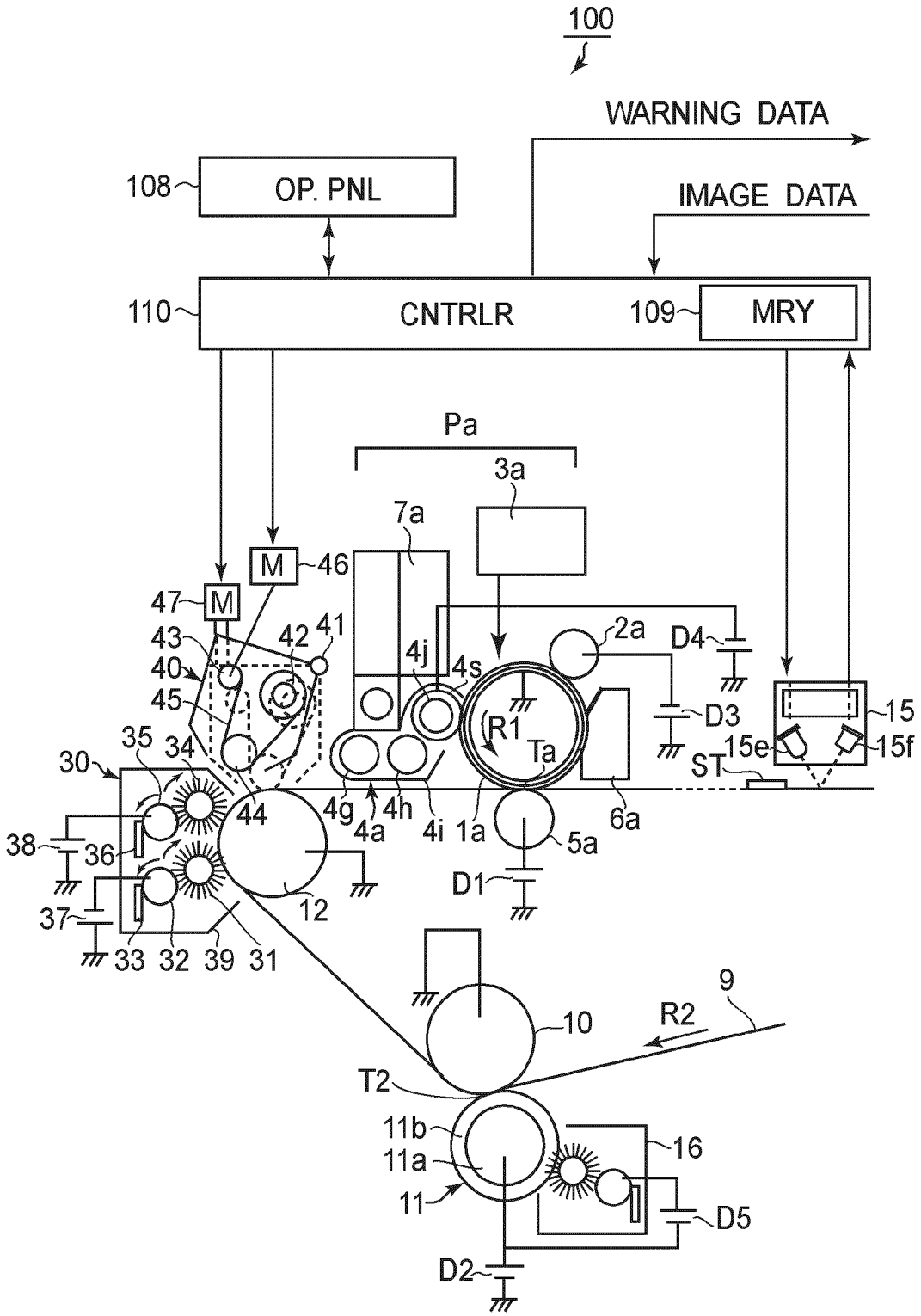
FIG. 2 is a schematic drawing showing a structural arrangement for cleaning the intermediary transfer belt.

FIG. 1 is a schematic sectional view of the image forming apparatus according to the first preferred embodiment of the present invention, and shows the general structure of the apparatus. FIG. 2 is a schematic drawing for describing the structural arrangement of the image forming apparatus, which is used for cleaning the intermediary transfer belt of the image forming apparatus.

Referring to FIG. 1, the image forming apparatus 100 according to the first embodiment is a full-color copying apparatus of the tandem type. It has an intermediary transfer belt 9, and yellow, magenta, cyan, and black image forming portions Pa, Pb, Pc, and Pd. The image forming portions are disposed in tandem along the intermediary transfer belt 9.

In the image forming portion Pa, a yellow toner image is formed on a photosensitive drum 1*a*, and then, is transferred (primary transfer) onto the intermediary transfer belt 9. In the image forming portion Pb, a magenta toner image is formed on a photosensitive drum 1*a*, and then, is transferred (primary transfer) onto the intermediary transfer belt 9 so that it is laid upon the yellow toner image on the intermediary transfer belt 9. In the image forming portions Pc and Pd, cyan and black toner images are formed on photosensitive drums 1*c* and 1*d*, respectively, and then, are transferred (primary transfer) onto the intermediary transfer belt 9 so that they are laid upon the yellow and cyan toner images on the intermediary transfer belt 9.

Then, the four monochromatic toner images, different in color, on the intermediary transfer belt 9, are conveyed to a secondary transfer portion T2, in which the four toner images are transferred together (secondary transfer) onto a recording medium P, which is being conveyed through the secondary transfer portion T2 by a pair of registration rollers 23 with a preset timing. After the secondary transfer of the toner images onto the recording medium P in the secondary transfer portion T2, the recording medium P is subjected to heat and pressure, in a fixing apparatus 25, so that the toner images are fixed to the surface of the recording medium P. Then, the recording medium P is discharged from the image forming apparatus 100.

As the recording medium P (or recording mediums P) is pulled out of a recording medium cassette 20 by a pickup roller, a separating apparatus 22 separates the top recording medium P from the rest, and sends the top recording medium P to the pair of registration rollers 23. As the recording medium P reaches the registration rollers 23, the rollers 23 catch the recording medium P and keep it on standby, while remaining stationary. Then, the registration rollers 23 are activated to release the recording medium P with such timing that the toner images on the intermediary transfer belt 9 and the recording medium P arrive at the secondary transfer portion T2 at the same time.

The intermediary transfer belt 9 is wrapped around a tension roller 12, a driver roller 13, and a backup roller 10, being suspended by the tension roller 12 and driver roller 13. It is circularly driven at a process speed of 300 mm/sec in the direction indicated by an arrow mark R2.

<Toner Image Forming Means>

The image forming portions Pa, Pb, Pc, and Pd are virtually the same in structure, although the developing apparatuses 4*a*, 4*b*, 4*c*, and 4*d* disposed next to the image forming portions Pa, Pb, Pc, and Pd, correspondingly, are different in the color of the toner they use; the developing apparatuses 4*a*, 4*b*, 4*c*, and 4*d* contain yellow, magenta, cyan, and black toners, correspondingly. Thus, only the image forming portion Pa will be described. That is, the description of the other image forming portions Pb, Pc, and Pd can be obtained by simply replacing the suffix a of the reference code Pa of the image forming portion Pa with b, c, and d, correspondingly.

Referring to FIG. 2, the image forming portion Pa is made up of a photosensitive drum 1*a*, a charge roller 2*a*, an exposing apparatus 3*a*, a developing apparatus 4*a*, a primary transfer roller 5*a*, and cleaning apparatus 6*a*. The charge roller 2*a*, exposing apparatus 3*a*, developing apparatus 4*a*, primary transfer roller 5*a*, and cleaning apparatus 6*a* are disposed in the adjacencies of the peripheral surface of the photosensitive drum 1*a* in a manner to surround the peripheral surface.

The photosensitive drum 1*a*, which is one of the primary image bearing members, is made up of an aluminum cylinder, and a layer of organic photo-conductor which is negative in intrinsic polarity. The organic photoconductor layer covers the entirety of the peripheral surface of the aluminum cylinder. The photosensitive drum 1*a* is rotatably supported at its lengthwise ends, by its flanges. It is rotated at a process speed of 300 mm/sec in the direction indicated by the arrow mark R1 by the driving force transmitted to one of the lengthwise ends of the photosensitive drum 1*a* from an unshown motor.

The charge roller 2*a* is kept pressed upon the peripheral surface of the photosensitive drum 1*a*, and is rotated by the rotation of the photosensitive drum 1*a*. An electric power source D3 uniformly charges the peripheral surface of the photosensitive drum 1*a* to the negative polarity by applying a combination of DC and AC voltages to the charge roller 2*a*.

The exposing apparatus 3*a* writes an electrostatic image of an original (image to be formed) on the charged peripheral surface of the photosensitive drum 1*a* by projecting a beam of laser light upon the charged portion of the peripheral surface of the photosensitive drum 1*a*, in a manner to scan the charged portion with the beam of laser light, while modulating (turning on and off) the beam of laser light with the data obtained by developing the monochromatic yellow image obtained by separating the intended full-color image.

The developing apparatus 4*a* has a developer container 4*i*, a development sleeve 4*s*, and a pair of screws 4*g* and 4*h*. The development sleeve 4*s* and pair of screws 4*g* and 4*h* are disposed in the developer container 4*i*. The developer container 4*i* contains a two-component developer, which is a mixture of nonmagnetic toner (which contains external additives) and magnetic carrier. The developing apparatus 4*a* charges the nonmagnetic toner and magnetic carrier to the negative and positive polarities, respectively, by stirring the two-component developer in the developer container 4*i* with the screws 4*g* and 4*h*. As the development sleeve 4*s* is rotated around a stationary magnet 4*j* in the direction opposite to the rotational direction of the photosensitive drum 1*a*, the charged toner particles are borne on the peripheral surface of the development sleeve 4*s*, with the external additive remaining adhered to the toner particles, and are carried to the development portion, where the body of toner on the peripheral surface of the development sleeve 4*s* is made to crest on the peripheral surface of the development sleeve 4*s*, and rubs the peripheral surface of the photosensitive drum 1*a*. The main ingredient of the external additive is microscopic powder of silica. It prevents toner particles from agglomerating, and also, enhances the efficiency with which the toner particles are frictionally charged as they are stirred.

An electric power source D4 applies a development voltage, which is a combination of a negative DC voltage and an AC voltage to the development sleeve 4*s*, thereby transferring the toner particles, to which the external additives have adhered, to the electrostatic image on the peripheral surface of the photosensitive drum 1*a*, which is positive in polarity relative to the development sleeve 4*s*. As a result, the electrostatic image is developed in reverse.

A toner bottle 7*a* contains a mixture of the nonmagnetic toner and external additives. As the nonmagnetic toner and external additives in the developing apparatus 4*a* are taken out (consumed) by the development of the electrostatic image, the mixture of the nonmagnetic toner and external additives is replenished with an additional mixture of the nonmagnetic toner and external additives so that the mixture of toner and carrier in the developing means container 4*i* remains constant in its ratio relative to the carrier in the container 4*i*.

The primary transfer roller 5*a* forms the primary transfer portion Ta between the peripheral surface of the photosensitive drum 1*a* and intermediary transfer belt 9, by being pressed against the peripheral surface of the photosensitive drum 1*a*, with the presence of the intermediary transfer belt 9 between the primary transfer roller 5*a* and photosensitive drum 1*a*.

An electric power source D1 applies a positive DC voltage to the primary transfer roller 5*a*, thereby transferring (primary transfer) the negatively charged toner image on the peripheral surface of the photosensitive drum 1*a*, onto the portion of the intermediary transfer belt 9, which is moving through the primary transfer portion Ta.

The cleaning apparatus 6*a* removes the transfer residual toner, that is, the toner remaining on the peripheral surface of the photosensitive drum 1*a*, on the immediately downstream side of the primary transfer portion Ta in terms of the moving direction of the peripheral surface of the photosensitive drum 1*a*. More specifically, the cleaning blade of the cleaning apparatus 6*a* is disposed on the immediately downstream side of the primary transfer portion 5*a* so that it rubs the peripheral surface of the photosensitive drum 1*a*. Thus, as the photosensitive drum 1*a* is rotated, the transfer residual toner is removed by the cleaning blade.

A secondary transfer roller 11 is kept pressed against the backup roller 10, with the presence of the intermediary transfer belt 9 between the secondary transfer roller 11 and backup roller 10, forming thereby the second transfer portion T2 between the intermediary transfer belt 9 and secondary transfer roller 11. The secondary transfer roller 11 is made up of a metallic cylindrical shaft 11*a*, and an electrically resistant elastic layer 11*b* (sponge layer) disposed in a manner to cover the entirety of the peripheral surface of the metallic shaft 11*a*. The roller shaft 11*a* is in connection to the electric power source D2. The backup roller 10 is a metallic cylinder, and is grounded.

The electric power source D2 applies a positive constant voltage to the cylindrical shaft 11*a* of the secondary transfer roller 11, thereby causing electric current (transfer current) to flow through the circuit made of the serial connection of the backup roller 10, intermediary transfer belt 9, recording medium P and secondary transfer roller 11, while the recording medium P is conveyed through the secondary transfer portion T2, with the toner image sandwiched between the intermediary transfer belt 9 and recording medium P. As a result, the toner image is electrostatically transferred from the intermediary transfer belt 9 onto the recording medium P.

A secondary transfer roller cleaning apparatus 16 is an electrostatic cleaning apparatus for electrostatically cleaning the secondary transfer roller 11. That is, as the charged fur brush of the cleaning apparatus 16 is rotated in a manner so as to rub the peripheral surface of the secondary transfer roller 11, the toner particles having adhered to the secondary transfer roller 11 are electrostatically removed from the secondary transfer roller 11 by the fur brush. More specifically, a positive DC voltage, which is higher in magnitude than the positive transfer voltage applied to the secondary transfer roller 11 by the electric power source D2, is applied to a metallic roller which is in contact with the fur brush, by an electric power source D5. As a result, the fur brush is positively charged relative to the potential level of the secondary transfer roller 11. Thus, the toner particles, which failed to be transferred onto the recording medium, and were transferred onto the secondary transfer roller 11, in the secondary transfer portion T2, are removed from the secondary transfer roller 11. Therefore, it does not occur that the following recording medium P is soiled on the back side by the transfer residual toner particles, in the secondary transfer portion T2.

<Intermediary Transfer Belt>

Figure 3:
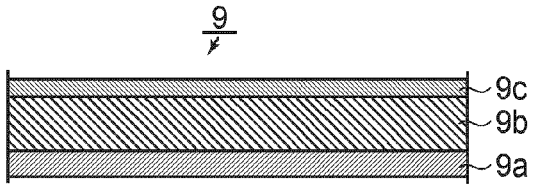
FIG. 3 is a sectional view of the intermediary transfer belt, at a plane perpendicular to the image bearing surface of the transfer belt, and depicts the structure of the belt.

FIG. 3 is a sectional view of the intermediary transfer belt 9, and shows the structure of the belt 9. In this embodiment, the intermediary transfer belt 9, which is the secondary member for bearing an image, is a laminar belt, being made up of an elastic belt made up of a resin layer 9*a*, an elastic layer 9*b*, and a surface layer 9*c*.

Referring to FIG. 3, the resin layer 9*a* is formed of a polyimide resin in which carbon particles have been dispersed. The elastic layer 9*b* is formed of the chloroprene rubber in which carbon particles have been dispersed. It is formed on the resin layer 9*a*. Further, the opposite surface of the elastic layer 9*b* from the resin layer 9*a* is covered with the surface layer 9*c*, which is formed of two or more among elastic substances, for example, fluorinated rubber, chlorinated polyethylene, urethane rubber, in which a substance or substances for improving the substances in lubricity by reducing them in surface energy. As for the examples of the substances for reducing the above-mentioned substances in lubricity by reducing them in surface energy, there are fluorinated resins, fluorinated compound, fluorocarbon, as base materials, in which one or more among powdery particles of titanium dioxide, silicon carbide, etc., have been dispersed.

The resin layer 9*a*, elastic layer 9*b*, and surface layer 9*c* have been adjusted to $10^9$ (Ωcm) in volumetric resistivity ρ (Ωcm). The volumetric resistivity ρ (Ωcm) of the intermediary transfer belt 9 is desired to satisfy the following inequality when it is measured with the use of a probe which meets JIS-K6911, while applying 100 V of voltage for 60 seconds at 23° C. in temperature and 50% in RH:

$$10^5(\Omega\text{cm}) \leqq \rho \leqq 10^{15}(\Omega\text{cm}).$$

<Electrostatic Cleaning Apparatus>

Referring to FIG. 2, as the intermediary transfer belt 9 is rotated, the transfer residual toner, that is, the toner which is on the downstream side of the intermediary transfer belt 9 relative to the secondary transfer portion T2 in terms of the moving direction intermediary transfer belt 9, is conveyed to an electrostatic cleaning apparatus 30, by which the transfer residual toner is recovered.

The electrostatic cleaning apparatus 30 has a pair of fur brushes 31 and 34. In order to electrostatically remove the transfer residual toner, the fur brush 31 is negatively charged, whereas the fur brush 34 is positively charged. As the intermediary transfer belt 9 is rotated in contact with the charged fur brushes 31 and 34, the transfer residual toner is electrostatically removed from the intermediary transfer belt 9.

The fur brushes 31 and 34 are made up of a metallic roller, and strands of nylon fiber embedded in the peripheral surface of the metallic roller at a density of 50 stands/inch. The nylon fiber is impregnated with carbon. It is 10 MΩ in electrical resistance, and 6 denier in thickness. The fur brushes 31 and 34 are disposed so that their apparent intrusion into the intermediary transfer belt 9 is roughly 1.0 mm. They are rotationally driven by an unshown motor at 50 mm/sec, in the opposite direction from the moving direction of the intermediary transfer belt 9.

The metallic rollers 32 and 35 are anodized aluminum cylinders, and are disposed in such a manner that their apparent intrusion into the fur brushes 31 and 34, respectively, is roughly 0.1 mm.

The metallic rollers 32 and 35 are driven by the driving force distributed from the rotational axes of the fur brushes 31 and 34, respectively, in such a direction that they are the same as the fur brushes 31 and 34 in terms of the moving direction in the interface between the metallic rollers 32 and 35, and fur brushes 31 and 34, respectively, at roughly the same peripheral velocities as the fur brushes 31 and 34, respectively.

Cleaning blades 33 and 36 are formed of urethane rubber. They are disposed in contact with the metallic rollers 32 and 35 so that their apparent intrusion into the metallic rollers 32 and 35, respectively, is 1.0 mm, and also, so that their cleaning edges are on the upstream side relative to their bases in terms of the rotational direction of the metallic rollers 32 and 35.

An electric power source 37 applies −750 V of voltage to the metallic roller 32, whereby current (cleaning current) flows through the series circuit made up of the intermediary transfer belt 9, fur brush 31, and metallic roller 32. Thus, in the interface between the intermediary transfer belt 9 and fur brush 31, the negative voltage of the fur brush 31 is higher in potential level than that of the intermediary transfer belt 9. Therefore, the transfer residual toner, that is, the positively charged toner on the immediately downstream side of the intermediary transfer belt 9 relative to the transfer portion T1 in terms of the moving direction of the intermediary transfer belt 9, is electrostatically adhered to the fur brush 31. Further, the uncharged toner particles having adhered to the intermediary transfer belt 9 are injected with negative charge, becoming therefore negatively charged, while they separate from the fur brush 31 after coming in contact therewith.

After having adhered to the fur brush 31, the transfer residual toner particles are electrostatically transferred onto metallic roller 32, which is negative in polarity relative to the fur brush 31. Then, they are scraped down by the cleaning blade 33 into a housing 39.

An electric power source 38 applies +700 V of voltage to the metallic roller 35, whereby current flows (cleaning current) through the series circuit made up of the metallic roller 35, fur brush 34, and intermediary transfer belt 9. Thus, in the interface between the intermediary transfer belt 9 and fur brush 34, the positive voltage of the fur brush 34 is higher in potential level than that of the intermediary transfer belt 9. Therefore, the transfer residual toner particles, that is, the positively charged toner particles on the immediately downstream side of the intermediary transfer belt 9 relative to the transfer portion T1 in terms of the moving direction of the intermediary transfer belt 9, are electrostatically adhered to the fur brush 34.

After having adhered to the fur brush 34, the transfer residual toner particles are electrostatically transferred onto metallic roller 35. Then, they are scraped down by the cleaning blade 36 into a housing 39.

<Cleaning Member>

The electrostatic cleaning apparatus 30 only electrostatically removes the charged particles having adhered to the intermediary transfer belt 9. Thus, it cannot clean the intermediary transfer belt 9 as well as the cleaning blade which mechanically removes microscopic particles having adhered to the intermediary transfer belt 9.

The external additive particles having separated from the toner particles are rubbed against the surface of the intermediary transfer belt 9, in a portion, such as the secondary transfer portion T2. Thus, they adhere to the surface of the intermediary transfer belt 9, and remain in the form of microscopic particles. While the external additives are in the form of microscopic particles, they cannot be efficiently recovered. Thus, a web-based cleaning apparatus 40 is disposed on the downstream side of the electrostatic cleaning apparatus 30 to mechanically recover the microscopic external additive particles; the particles are adhered to the cleaning web 45 of the cleaning apparatus 40. That is, the image forming apparatus 100 is provided with the web-based cleaning apparatus 40 to prevent the problem that as the external additive particles adhere to the intermediary transfer belt 9 by a large amount, some of them remain on the intermediary transfer belt 9 even though the intermediary transfer belt 9 is cleaned by the electrostatic cleaning apparatus 30.

More specifically, the web-based cleaning apparatus 40 is provided with the cleaning web 45, which is formed of unwoven fabric and is positioned so that it rubs the intermediary transfer belt 9, across the portion of the intermediary transfer belt 9, which is backed up by the tension roller 12. Thus, the microscopic external additive particles, paper particles, etc., which have adhered to the intermediary transfer belt 9, are removed by being tangled in the fibers of the cleaning web from the intermediary transfer belt 9 by the fibers of the cleaning web 45.

The cleaning web 45 is provided in the form of a roll, the inward end of which is fixed to a feed roller 42. It is mounted in the web-based cleaning apparatus 40, and its outward end is fixed to the take-up roller 43 of the web-based cleaning apparatus 40. More specifically, the cleaning web 45 is set in the web-based cleaning apparatus 40 by fitting the feed roller 42 and take-up roller 43 around a pair shafts, one for one, with which the image forming apparatus is provided, in such a manner that its mid portion between the feed roller 42 and take-up roller 43 wraps halfway around a web roller 44 of the apparatus 40.

The cleaning web 45 is formed of one or more among the fibers formed of polyester, acrylic, vinylon, water-soluble vinylon, rayon, nylon, polypropylene, etc., and cotton fiber. However, the selection of the fibrous material for the cleaning web 45 is not limited to those listed above.

As the intermediary transfer belt 9 is cleaned with the cleaning web 45, the contaminants of the intermediary transfer belt 9 collect on the fibrous structure of the cleaning web 45. Thus, if the same portion of the belt rubbing surface of the cleaning web 45 is used for a long time, the number of the microscopic particles of the contaminants released by the fibrous structure of the cleaning web 45 becomes virtually equal to the number of the microscopic particles of the contaminants captured by the fibrous structure of the cleaning web 45, reducing this portion of the belt rubbing surface of the cleaning web 45 to zero in terms of apparent cleaning performance; the external additive particles are likely to pass through the nip between the cleaning web 45 and intermediary transfer belt 9, and then, adhere again to the intermediary transfer belt 9.

Thus, in order to restore the web-based cleaning apparatus 40 in cleaning performance, the cleaning web 45 is taken up by a preset length for every preset length of time to refresh the rubbing surface (cleaning surface) of the cleaning web 45, that is, the portion of the cleaning web 45 that faces the intermediary transfer belt 9. In this embodiment (first embodiment), the timing for taking up the cleaning web 45 is set to once every 30 seconds, and the length by which the cleaning web 45 is taken up is set to 5 mm per take-up.

More specifically, a control portion 110 activates a motor 46 once every 30 seconds to rotate the take-up roller 43 by one pitch, pulling out thereby the cleaning web 45 by 5 mm from the feed roller 42. Thus, the portion of the cleaning web 45, which has been soiled by being rubbed against the intermediary transfer belt 9, is replaced by the adjacent portion, that is, the brand-new portion, of the cleaning web 45. Therefore, the contaminants having adhered to the image bearing surface of the intermediary transfer belt 9 are continuously and satisfactorily removed from the interface between the cleaning web 45 and intermediary transfer belt 9, in which the intermediary transfer belt 9 is cleaned by the cleaning web 45.

The used portion of the cleaning web 45 is taken up by the take-up roller with the above-mentioned timing. As the feed roller 42 runs out of the cleaning web 45, the roll of cleaning web 45 in the web-based cleaning apparatus 40 is replaced with a brand-new roll of cleaning web 45.

Incidentally, the apparatus for cleaning the intermediary transfer belt 9 does not need to be the web-based cleaning apparatus 40 which employs the cleaning web 45. That is, it may be replaced with a cleaning apparatus of another type which can efficiently capture the particles of external additives having adhered to the image bearing surface of the intermediary transfer belt 9. For example, it may be replaced with a roller-based cleaning apparatus, or the like, which is made up of a roller, the peripheral surface of which is wrapped with unwoven cloth, and which is rotationally driven in contact with the intermediary transfer belt 9.

The web-based cleaning apparatus 40 is attached to the main assembly of the image forming apparatus in such a manner that it is rotationally movable about its rotational axis 41 to separate the cleaning web 45 from the intermediary transfer belt 9 by operating a pressure relieving mechanism 47. Further, the web-based cleaning apparatus 40 is structured so that the contact pressure between the intermediary transfer belt 9 and cleaning web 45 can be adjusted by operating the pressure relieving mechanism 47.

When the web-based cleaning apparatus 40 is in its operational position, the total amount of contact pressure between the web roller 44, halfway around which the cleaning web 45 is wrapped, and the intermediary transfer belt 9, is variable in a range of 20 N (2.0 kgf)-50 N (5.0 kgf). During an ordinary image forming operation, the contact pressure between the intermediary transfer belt 9 and web roller 44 is 30 N (3.0 kgf).

When the web-based cleaning apparatus 40 is in retreat, the cleaning web 45 remains separated from the intermediary transfer belt 9, allowing the toner particles and other microscopic particles on the intermediary transfer belt 9 to pass through the gap between the cleaning web 45 and intermediary transfer belt 9.

<Optical Sensor>

Figure 4:
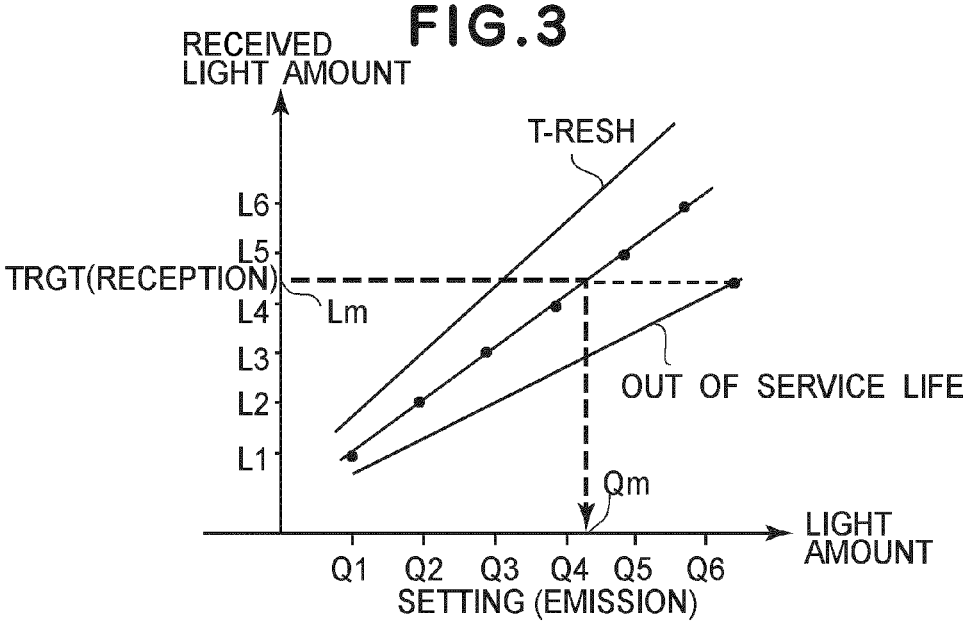
FIG. 4 is a graph for describing how the LED of the optical sensor is set in the amount of light.
Figure 5:
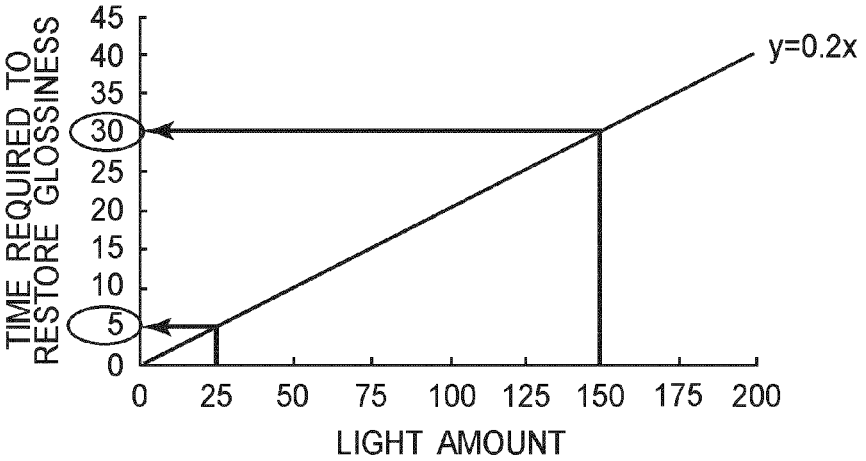
FIG. 5 is a graph which shows the relationship between the amount of light from the LED and the length of time the image forming apparatus must be operated in the glossiness restoration mode.

FIG. 4 is a graph for describing how the LED of the optical sensor (detecting member) is set in the amount by which it is to emit light (amount of light emission). FIG. 5 is a graph for describing the relationship between the amount of light emission of the LED and the length of time the image forming apparatus is to be operated in the glossiness restoration mode.

Referring to FIG. 2, the control portion 110 controls the image forming apparatus 100 automatically, or according to the commands inputted through a control panel 108 made up of a touch panel or the like.

The control portion 110 forms various control images ST of toner, on the portion of the intermediary transfer belt 9, which corresponds to the interval between the consecutive two images on the intermediary transfer belt 9, and detects the control image ST formed of toner, with the use of the optical sensor 15. Then, based on the results of the detection, it adjusts the image forming apparatus in the toner image formation settings, and the timing with which an electrostatic image is written.

Then, the control portion 110 forms various control images ST of toner (which hereafter will be referred to as control toner image ST), on the intermediary transfer belt 9, across the intervals between the toner images, one for one, and detects the control toner images ST with the use of the optical sensor 15. Then, based on the results of the detection, the control portion 110 adjusts the timing (exposure timing) with which an electrostatic image is written on the photosensitive drum 1*a*.

More specifically, after the transfer (primary transfer) of an image of a yellow color patch onto the intermediary transfer belt 9, the control portion 110 detects the yellow color patch image on the intermediary transfer belt 9 with the use of the optical sensor 15. Then, based on the results of the detection, it adjusts the settings for forming a toner image in the image forming portion Pa.

The optical sensor 15 projects a beam of infrared light upon the intermediary transfer belt 9 at a preset angle, and detects the portion of the beam, which is regularly reflected by the intermediary transfer belt 9; it detects the contrast between the surface of the intermediary transfer belt 9, which is free of the control toner image ST, and the control toner image ST.

More specifically, the optical sensor 15 projects a beam of infrared light, from its internal LED 15*e*, so that the beam of infrared light becomes incident upon the surface of the intermediary transfer belt 9 at a preset angle, and detects the regular reflection of the beam of infrared light by the intermediary transfer belt 9 (and control toner image ST thereon), with the use of its light receiving element 15*f* which is roughly symmetrically positioned relative to the LED 15*e*. Further, the LED 15*e* and light receiving element 15*f* are disposed so that their optical axes coincide with a plane, which is perpendicular to both the image bearing surface of the intermediary transfer belt 9 and the widthwise direction of the intermediary transfer belt 9.

The optical sensor 15 automatically adjusts the amount by which electric current flows through the LED 15*e*, in response to the 8 bit signals sent from the control portion 110; it sets the amount by which light is emitted by the LED 15*e*, to one of the values which correspond to 255 steps, one for one, in which the amount can be adjusted. Further, the optical sensor 15 waits for the arrival of the control toner image ST borne on the intermediary transfer belt 9, with the amount of the light emission of the LED 15*e* set to the specific value, and, detects the amount by which the light by the LED 15*e* is received by the light receiving element 15*f*, in relation to the size and density of the control toner image ST within the range of the light receiving element 15*f*.

Referring to FIGS. 2 and 4, when the image forming apparatus 100 is on, the control portion 110 adjusts the LED 15*e* of the optical sensor 15 in the amount by which light is emitted by the LED 15*e* so that the amount by which the contrast detection light reflected by the intermediary transfer belt 9 is received matches a preset value. The optical sensor 15 waits for the arrival of the control toner image ST borne by the intermediary transfer belt 9, with the LED 15*e* set as described above, and detects the amount by which the light is received by the light receiving element 15*f*, in relation to the size and toner density of the control toner image ST within the field of vision of the light receiving element 15*f*.

Next, referring to FIGS. 2 and 4, as the image forming apparatus 100 is turned on, the control portion 110 adjusts the LED 15*e* in the amount by which the LED 15*e* emits light, so that the amount, by which the light emitted by the LED 15*e* is received by the light receiving element 15*f* after being reflected by the intermediary transfer belt 9, matches the target value Lm.

The control portion 110 sequentially transmits six signals which correspond, one for one, to 6 steps (6 light amount values Q1-Q6) in which the amount by which light is emitted by the LED 15*e* can be varied, to make the LED 15*e* emit light by the amounts Q1-Q6, one for one. Then, the amounts (L1-L6), by which the beam of infrared light (which is varied in amount to Q1-Q6) are detected by the light receiving element 15*f* after being regularly reflected by the intermediary transfer belt 9. Then, the control portion 110 reads, from the optical sensor 15, the measured amount L1-L6, which correspond, one for one, to the amount Q1-Q6 by which light is emitted by the LED 15*e*.

Then, the control portion 110 formulates a linear equation by linearly interpolating the data regarding the relationship between the amount Q by which light is emitted by the LED 15*e* and the amount L by which the light emitted by the LED 15*e* is received by the light receiving element 15*f*, which is obtained by controlling the optical sensor 15. Then, the control portion 110 uses this linear equation to obtain the amount Qm by which light is to be emitted by the LED 15*e* so that the amount by which the light is received by the light receiving element 15*f* matches the target value Lm, which can be calculated with the use of the above-mentioned linear equation. Then, the control portion 110 sets the LED 15*e* so that the LED 15*e* emits light by the amount Qm.

When the intermediary transfer belt 9 is brand-new, for example, right after the replacement of the intermediary transfer belt 9, the amount by which the beam of infrared light is normally reflected by the background of the control toner image ST can be made to be the target amount Lm, by adjusting the LED 15*e* to value Q3 in intensity. However, as the intermediary transfer belt 9 increases in the cumulative usage, it also increases in the amount of the external additives having adhered thereto. The adhesion of the external additives to the intermediary transfer belt 9 reduces the intermediary transfer belt 9 in reflectivity. Thus, as the intermediary transfer belt 9 increases in the cumulative usage, it is possible that even if the LED 15*e* is set to value Q6 in intensity, the amount L by which the beam of infrared light emitted by the LED 15*e* is normally reflected by the background portion (surface of intermediary transfer belt 9) of the control toner image ST does not reach the target level Lm. In other words, as the intermediary transfer medium 9 reduces in reflectivity below a certain value, it becomes impossible to properly adjust the optical sensor 15 in the amount by which its LED 15*e* emits light.

That is, as the intermediary transfer belt 9 increases in the amount of the contaminants (external additives) having adhered thereto, it becomes difficult for the control portion 110 to properly read the control toner image ST formed on the intermediary transfer belt 9; even if two control toner images ST used for detection are identical, the detection sensor 15 outputs two different values as the amounts by which the light from the LED 15*e* was received. Further, in a case where the LED 15*e* is adjusted in the amount of light to a value close to the upper limit (255/255) of the range in which the LED 15*e* is adjustable in the amount of light, the optical sensor 15 reduces in the accuracy with which it can read the control toner image ST on the intermediary transfer belt 9. As the optical sensor 15 reduces in the accuracy with which it can read the control toner image ST, the image forming apparatus is likely to form images which suffer from color deviation, images which are nonuniform in color, density, etc.

Thus, as the light amount Qm of the LED 15*e* of the optical sensor 15 reaches a reference value (which hereafter will be referred to as intermediary transfer belt restoration threshold value, or simply, restoration threshold value), the control portion 110 automatically starts operating the image forming apparatus in the mode for restoring the intermediary transfer belt 9 in glossiness (which hereafter will be referred to simply as glossiness restoration mode). While the image forming apparatus is in the glossiness restoration mode, the ongoing image forming operation remains interrupted, and the web-based cleaning apparatus 40 is moved into the position in which the cleaning web 45 remains in contact with the intermediary transfer belt 9. Then, the intermediary transfer belt 9 is idled to restore the intermediary transfer belt 9 in glossiness.

In other words, the image forming operation is suspended until the operation in the glossiness restoration mode is completed. Thus, if the image forming apparatus is frequently operated in the glossiness restoration mode, the cumulative length of time the image forming apparatus is prevented from forming images becomes substantial, significantly reducing thereby the image forming apparatus 100 in the ratio of the actual image forming operation.

Referring to FIG. 5, as the optical sensor 15 is increased in the light amount Q, the length of time necessary for the glossiness restoration mode linearly increases. In a case where the light amount Qm is 25/255 immediately after the replacement of the intermediary transfer belt 9, the length of time the image forming apparatus 100 must be operated in the glossiness restoration mode to restore the intermediary transfer belt 9 in glossiness to a preset level is only 5 minutes. However, in a case where the light amount Qm is as high as 150, for example, a case where the intermediary transfer belt 9 is close to its end of the expected service life, the image forming apparatus 100 must be operated 30 minutes in the glossiness restoration mode, in order to restore the intermediary transfer belt 9 to the same level in glossiness. There is no problem as long as the intermediary transfer belt 9 recovers in glossiness as the image forming apparatus 100 is operated 30 minutes in the glossiness restoration mode. However, in such a case, or the like, as where the image forming apparatus 100 is operated 30 minutes in the glossiness restoration mode when the light amount Qm is no less than 200/250, it is possible that the residual toner on the intermediary transfer belt 9 will fuse to the surface of the intermediary transfer belt 9, preventing thereby the intermediary transfer belt 9 from being restored in glossiness.

Therefore, from the standpoint of keeping as small as possible the amount of stress to which a user is subjected, insuring the image forming apparatus 100 in image quality, and prolonging the image forming apparatus 100 in service life, it is desired that the image forming apparatus 100 is frequently operated in the glossiness restoration mode before the light amount Qm set for the optical sensor 15 becomes substantial.

Embodiment 1

Control Portion

Figure 6:
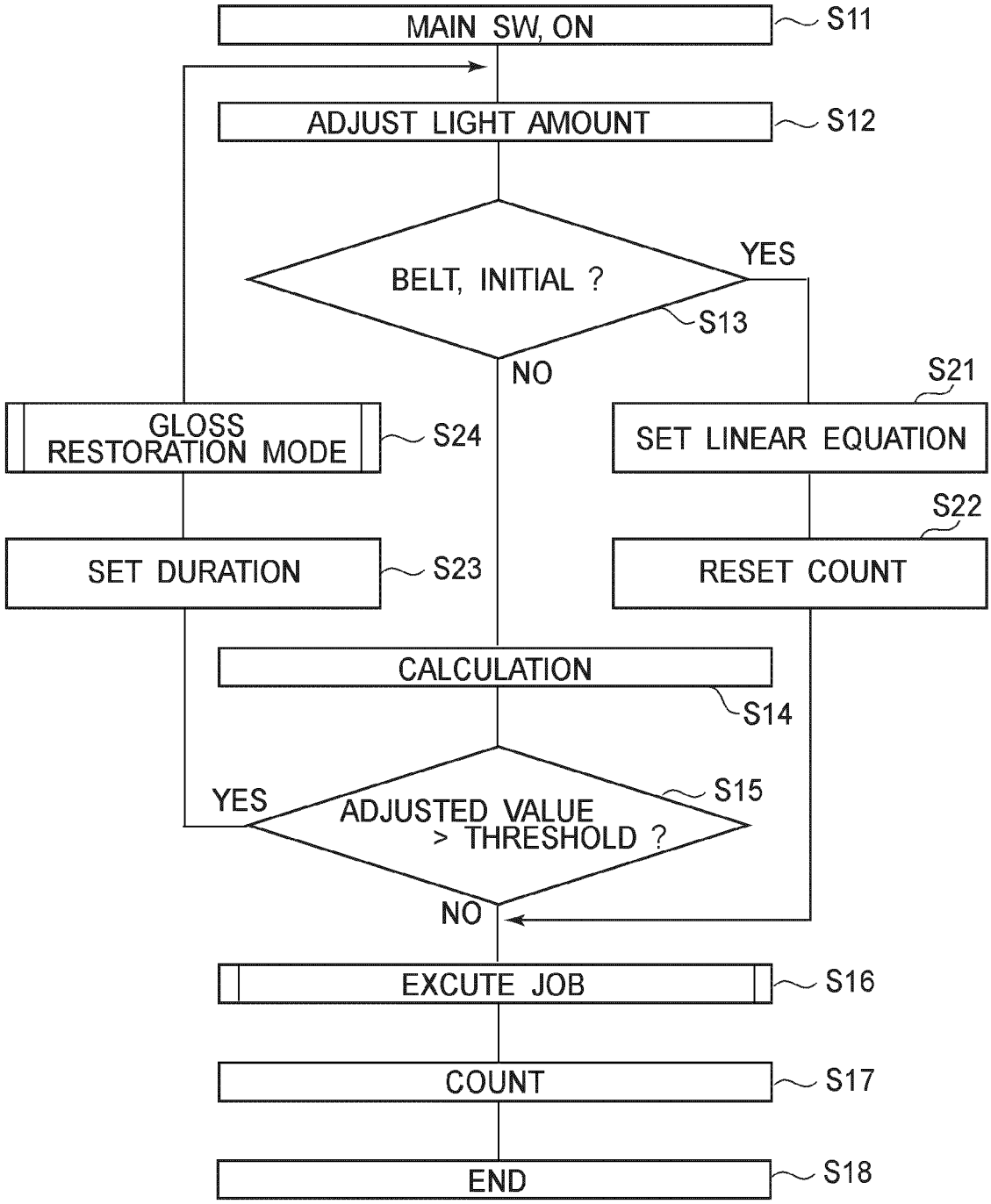
FIG. 6 is a flowchart of the mode for restoring the intermediary transfer belt 9 in glossiness.
Figure 7:
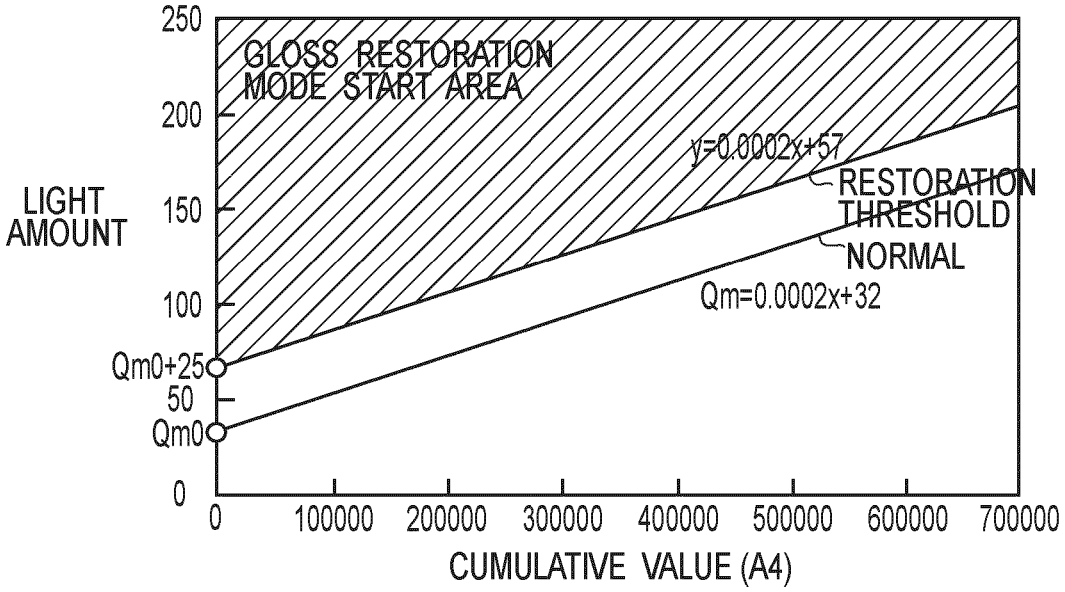
FIG. 7 is a graph for describing the glossiness restoration threshold for the glossiness restoration mode, according to the first embodiment.
Figure 8:
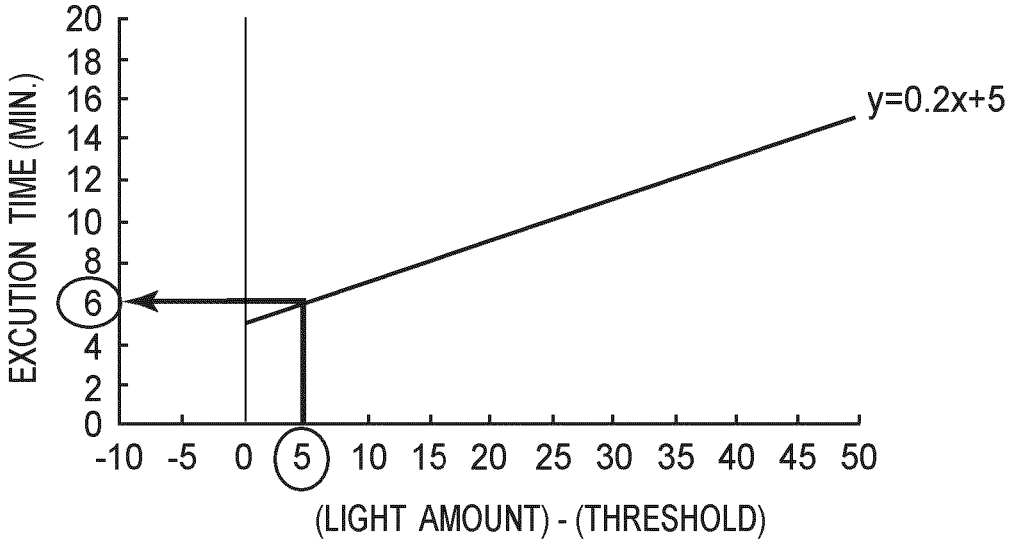
FIG. 8 is a graph for describing the length of time the image forming apparatus is to be operated in the glossiness restoration mode.
Figure 9:
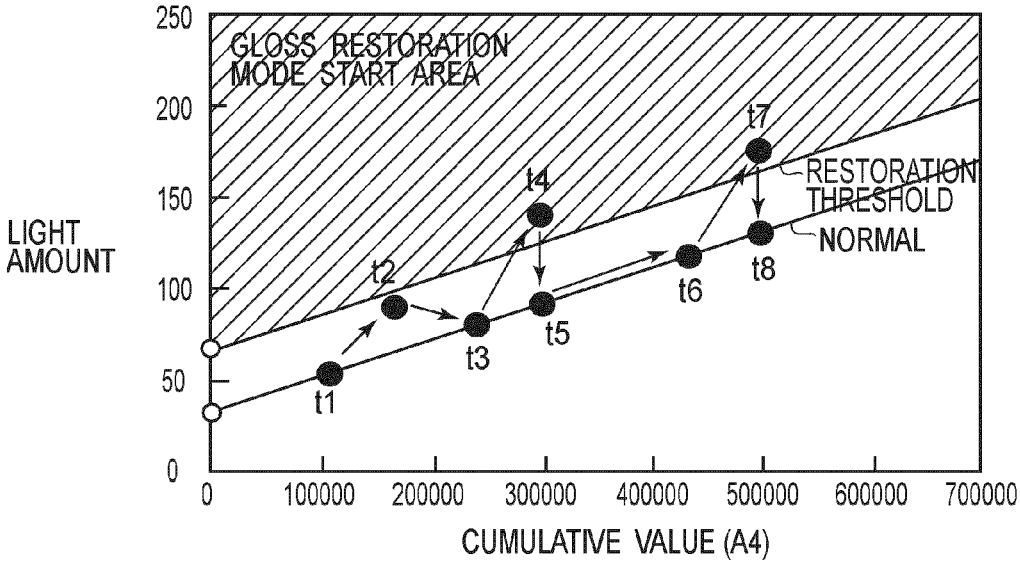
FIG. 9 is a graph for describing the changes which have to be made in the amount by which light is emitted by the LED of the optical sensor, according to the increase in the cumulative usage of the intermediary transfer belt.

First, the control portion (CPU) in this embodiment will be described. The control portion in this embodiment has the function of controlling an image forming apparatus, and the function of controlling an optical sensor. It also has the function of adjusting the image forming apparatus in the settings at which a toner image is formed on an image bearing member. Further, it has a function of operating the image forming apparatus in the cleaning mode, that is, the mode for cleaning the intermediary transfer belt with the use of a cleaning member (cleaning web), as the amount by which light is emitted by an optical sensor reaches a reference value. Moreover, it has the function of changing the reference value. FIG. 6 is a flowchart of the operation in the glossiness restoration mode for restoring the intermediary transfer belt 9 in glossiness, and FIG. 7 is a graph for describing the threshold value for the glossiness restoration mode. FIG. 8 is a graph for described the length of time the image forming apparatus is to be operated in the glossiness restoration mode, and FIG. 9 is a graph for describing the changes in the amount by which light is emitted by the LED of the optical sensor, relative to the cumulative length of usage of the intermediary transfer belt.

First, referring to FIGS. 2 and 5, as soon as the image forming apparatus 100 is started (S11), the control portion 110 sets the amount Qm by which light is emitted by the LED 15*e* of the optical sensor 15 (S12).

In a case where it is immediately after the replacement of the intermediary transfer belt 9 (YES in S13), the control portion 110 formulates the linear equation for calculating the restoration threshold value, based on the latest value to the light amount Qm was set (S21), and resets the cumulative counter for the number of the images formed (S22).

Next, referring to FIGS. 2 and 6, when the intermediary transfer belt 9 is in the new condition, and the initial value Qm0 of the light amount Qm of the optical sensor 15 is 32, the initial value for the restoration threshold level is set to 57, which is the value obtained by adding a preset value 25 to the initial value 32.

The linear equation for obtaining the restoration threshold value is formulated so that the restoration threshold value is gradually increased as the image forming apparatus increases in the cumulative number of images formed. That is, the restoration threshold value y can be calculated with the use of the following linear equation:

$$y=0.0002X+57 \quad (1).$$

When it is not immediately after the replacement of the intermediary transfer belt 9 (NO in S13), the restoration threshold value y can be obtained by substituting X in Linear Equation (1), with the cumulative number of images formed after the replacement of the intermediary transfer belt 9.

In a case where the latest value to which the light amount Qm was set is greater than the restoration threshold value y (YES in S15), the length Tk of time (which corresponds to difference ΔQm between restoration threshold value y and light amount Qm) the image forming apparatus is to be operated in the glossiness restoration mode is calculated using Linear Equation (2) (S23).

Referring to FIG. 8, the length Tk of time the image forming apparatus is to be operated in the glossiness restoration mode is determined using the following linear equation and the difference ΔQm between the restoration threshold value y and light amount Qm:

$$Tk\ (\text{minutes})=0.2\times\Delta Qm+5 \quad (2).$$

Therefore, in a case where the light amount Qm is greater by (5/255) than the restoration threshold value y, the length Tk of time the image forming apparatus is to be operated in the glossiness restoration mode is six minutes: Tk=0.2×5+5=6.

In the glossiness restoration mode, the web-based cleaning apparatus 40 is positioned so that the total amount of contact pressure between the web-based cleaning apparatus 40 (cleaning web) and the intermediary transfer belt 9 remains at 30 N (3.0 kgf). To the charge roller 2*a*, the normal charge voltage is applied from the electric power source D3, and to the development sleeve 4*s*, only a negative DC voltage is applied from the electric power source D4, with the development sleeve 4*s* kept stationary. Thus, the photosensitive drum 1*a* rotates with the intermediary transfer belt 9 without bearing a toner image.

Also in the glossiness restoration mode, the speed at which the cleaning web 45 is taken up (wound), is increased from the normal speed (5 mm for every 30 seconds) to 5 mm for every 10 seconds, to make the web-based cleaning apparatus 40 higher in external additive cleaning performance than in the normal image forming operation.

Referring to FIGS. 2 and 5, after restoring the intermediary transfer belt 9 in glossiness by continuously operating the image forming apparatus 100 in the glossiness restoration mode for the length Tk of time (S24), the control portion 110 resets the light amount Qm (S12), because once the intermediary transfer belt 9 is restored in glossiness, the glossiness level of the background portion of the control toner image ST does not match the target level Lm shown in FIG. 4.

If the latest value set for the light amount Qm is no higher than the restoration threshold value y (NO in S15), the control portion 110 allows the image forming apparatus 100 to carry out (continue) the image forming job (S16), and counts up the cumulative number X by which the image forming apparatus formed images (S17).

Next, referring to FIG. 2, it has been known that as long as the light amount Qm normally changes corresponding to the cumulative number X by which images have been formed by the image forming apparatus 100, the rate of the change is 0.0002/image. Thus, the normal change in the light amount Qm, which occurs when the initial value Qm0 of the light amount Qm of the optical sensor 15 is 32/255 and the intermediary transfer belt 9 is in the new condition, can be obtained by the following Linear Equation:

$$Qm=0.0002X+32 \quad (3).$$

The normal changes which occur to the light amount Qm, corresponds to the speed at which the intermediary transfer belt 9 is reduced in the glossiness by the balance between the amount of the external additives coated on the intermediary transfer belt 9 through the normal image forming operations, and the external additive cleaning performance of the web-based cleaning apparatus 40, during an image forming operation.

As the intermediary transfer belt 9 increases in the amount of the external additives thereon, it gradually reduces in glossiness, and therefore, the amount by which the light receiving element 15*f* receives the light emitted by the LED 15*e* and regularly reflected by the intermediary transfer belt 9, also reduces. Thus, the amount Qm by which the detection light is to be emitted by the LED 15*e* to ensure that the light receiving element 15*f* receives the light from the LED 15*e* by the amount equal to the target value Lm, gradually increases.

Thus, as the value of the light amount Qm reaches 250/255, which is very close to the upper limit of the range in which the light amount Qm can be set, it becomes highly possible that the control toner image ST on the intermediary transfer belt 9 cannot be accurately read by the optical sensor 15. Therefore, the control portion 110 determines that the intermediary transfer belt 9 has reached the end of its optical life. Then, it automatically starts operating the image forming apparatus in the glossiness restoration mode.

However, as long as the increase in the light amount Qm follows Linear Equation (3), the light amount Qm never reaches 250, that is, the upper limit in the range in which the light amount Qm can be set, until the cumulative number X reaches 1,100,000, which is substantially greater than 70,0000, which the service life of the intermediary transfer belt 9 in mechanical terms.

Further, as long as the increase in the light amount Qm corresponds to the change in the restoration threshold value y obtainable by Equation (1), the light amount Qm does not reach 250, which is the upper limit in the range in which the light amount Qm can be set, until the cumulative number X of the images formed reaches 1,000,000, which is substantially greater than the designed service life of the intermediary transfer belt 9, in terms of the cumulative number X of images formable with the use of the intermediary transfer belt 9, which is 700,000.

Referring to FIG. 8, the difference 25/255, shown in FIG. 7, between the light amount Qm and restoration threshold value y is equivalent to the amount by which the light amount Qm is expected to decrease when the image forming apparatus is operated 5 minutes in the glossiness restoration mode. That is, as the image forming apparatus is operated 5 minutes in the glossiness restoration mode, the light amount Qm decreases by 25/255 from the straight line, in FIG. 7, which represents the restoration threshold value y obtainable from Equation (1), onto the straight line, in FIG. 7, which represents the normal change in the light amount Qm obtainable with the use of Equation (3). Each minute in the 6 minutes, shown in FIG. 8, is the length of time necessary to lower the light amount Qm, which is greater by ΔQm (=5/225) than the restoration threshold value y, to the restoration threshold value y (amount by which the intermediary transfer belt 9 recovers in glossiness).

Therefore, the amount by which the intermediary transfer belt 9 is to be restored in glossiness to cause the light amount Qm, which has increased to a certain level, which is higher than the restoration threshold value y, to move back onto the straight line which represents the normal change in the light amount Qm, can be obtained (calculated) with the use of Equation (3).

Next, referring to FIGS. 2 and 9, during the period between times t1 and t2, in which the light amount Qm set by the optical sensor 15 does not reach the restoration threshold value y, which is greater by 25/255 than the normal change in the light amount Qm, the image forming apparatus is not operated in the glossiness restoration mode. As the light amount Qm becomes greater than the restoration threshold value y at time t4, the intermediary transfer belt 9 is restored in glossiness by operating the image forming apparatus in the glossiness restoration mode. Thus, the value to which the light amount Qm is reset at a time t5 after the restoration of the intermediary transfer belt 9 in glossiness, is back on the straight line which represents the normal change.

Then, the image forming apparatus is controlled in a similar manner to the manner in which it was operated before time t1. During the period from time t5 to time t6, the image forming apparatus is not operated in the glossiness restoration mode. Then, as the value of the light amount Qm exceeds the restoration threshold value y, the image forming apparatus begins to be operated in the glossiness restoration mode at time t7. The value to the light amount Qm is reset at time t8 after the completion of the operation in the glossiness restoration mode, is back on the straight line which represents the normal change of the light amount Qm.

That is, when the value Qm(a) of the light amount Qm set for the optical sensor 15 based on the cumulative number a of the images formed with the use of the intermediary transfer belt 9 is less than the value y(a) of the restoration threshold level which corresponds to the light amount Qm(a), that is, when the following Inequality is satisfied:

$$Qm(a)-y(a)<0,$$

the image forming apparatus is not operated in the glossiness restoration mode, whereas when the value Qm(a) of the light amount Qm set for the optical sensor 15 based on the cumulative number a of the images formed with the use of an intermediary transfer belt 9 is no less than the value y(a) of the restoration threshold level, which corresponds to the light amount Qm(a), that is, when the following Inequality is satisfied:

$$Qm(a)-y(a)\geqq 0,$$

the image forming apparatus is operated in the glossiness restoration mode for the length Tk of time (in minutes) calculated by the following equation:

$$Tk=0.2\times(Qm(a)-y(a)).$$

If the value to which the light amount Qm is reset each time the optical sensor 15 is adjusted in the light amount Qm exceeds the restoration threshold level which corresponds to the cumulative number X of the images formed, the control portion 110 determines that the intermediary transfer belt is in the abnormal condition. Then, control portion 110 operates the image forming apparatus in the glossiness restoration mode. Therefore, while the intermediary transfer belt 9 is normally changing in glossiness, the image forming apparatus is not operated in the glossiness restoration mode. Thus, the image forming apparatus is operated in the glossiness restoration mode with the lowest frequency necessary.

Even when the image forming apparatus is in the glossiness restoration mode, the intermediary transfer belt 9 is not excessively restored in glossiness; the intermediary transfer belt 9 is not restored enough in glossiness to make the intermediary transfer belt 9 higher in glossiness level than the level at which it will be when the light amount Qm normally changes. Therefore, the length of time the image forming apparatus must be operated in the glossiness restoration mode (length of time image forming apparatus is kept on standby in terms of image forming operation) is the shortest necessary. The amount by which the intermediary transfer belt 9 is restored in glossiness is set so that it does not become less than the normal amount by which the intermediary transfer belt 9 is changed in glossiness by its usage.

Further, the toner recovered by the fur brush 31 of the electrostatic cleaning apparatus 30 is different in polarity from the toner recovered by the fur brush 34 of the electrostatic cleaning apparatus 30. Thus, the amount by which the transfer residual toner is recovered by the fur brush 31 is likely to be different from the amount by the transfer residual toner is recovered by the fur brush 34, and the difference is affected by the image type. That is, in a case where the image forming apparatus is used for forming an image which is high in density, the negative charged toner particles are greater in number than the positively charged toner particles. Therefore, the fur brush 34, which is provided with a positive voltage, is more soiled than the fur brush 31, which is provided with a negative voltage. On the other hand, in a case where the image forming apparatus is used for forming an image which is relatively low in density, the positively charged transfer residual toner particles are greater in number than the negatively charged transfer residual toner particles. Therefore, the fur brush 31, which is provided with the negative voltage, is more soiled than the fur brush 34, which is provided with the positive voltage.

Therefore, not only is the amount by which the transfer residual toner is recovered affected by the image density, but also, the difference between the extent to which the fur brush 31 is soiled and the extent to which the fur brush 34 is soiled is affected by the image density. Thus, as the image forming operation continues, the fur brush 31 becomes different in electrical resistance from the fur brush 34. Moreover, it is possible that all the fur brushes (31, 34) are not equal in electrical resistance, and also, that some fur brushes (31, 34) may change in the amount of electrical resistance. Thus, the initial voltages for the fur brushes 31 and 34 are continuously used, that is, the voltages for the fur brushes 31 and 34 are not changed, the voltages for the fur brushes 31 and 34 become improper for cleaning, making it possible that the intermediary transfer belt 9 will be unsatisfactorily cleaned.

Further, if the values of the voltages applied to the fur brushes 31 and 34 are smaller than the proper values, respectively, the fur brushes 31 and 34 are weaker in the force for keeping the residual toner particles confined in themselves. Therefore, it is possible that the residual toner particles captured by the fur brushes 31 and 34 will be thrown from the fur brushes 31 and 34, by the centrifugal force resulting from the rotation of the fur brushes 31 and 34, and also, by the rubbing of the fur brushes 31 and 34 by the intermediary transfer belt 9.

Further, if the values of the voltages applied to the fur brushes 31 and 34 are greater than the proper values, respectively, it is possible that after the residual toner particles are recovered by the fur brushes 31 and 34, they will be injected with electric charge by the voltages applied to the fur brushes 31 and 34, or by the electrical discharge caused by the excessive amount of voltage. If the transfer residual toner particles are injected with electric charge, it is possible that they will reverse in the polarity of their charge, and therefore, the residual toner particles will be thrown from the fur brushes 31 and 34.

If a large amount of toner is thrown from the fur brushes 31 and 34 all at once, the combination of the toner and external additives collects by a large amount on the cleaning web of the web-based cleaning apparatus 40 which is on the downstream side of the electrostatic cleaning apparatus 30. As a result, the cleaning web 45 plays the opposite role from the role assigned to the cleaning web 45; it coats the intermediary transfer belt 9 with the toner and external additive as it rubs the intermediary transfer belt 9. Thus, it sometimes occurs that if a large amount of toner is thrown from the fur brushes 31 and 34 all at once, the intermediary transfer belt 9 suddenly reduces in glossiness. In this situation, the light amount Qm necessary for the light receiving element 15*f* to receive, by a preset amount, the beam of light reflected by the intermediary transfer belt 9 suddenly increases. If the value of the light amount Qm reaches and remains at the upper limit, the optical sensor 15 loses its image reproducing ability necessary to read the control toner image ST, making it impossible to properly detect and/or measure the control toner image ST.

In anticipation of the occurrence of such situations as those described above, the control portion 110 begins operating the image forming apparatus in the glossiness restoration mode, and restores the intermediary transfer belt 9 in glossiness by a minimal amount necessary. Operating the image forming apparatus in the glossiness restoration mode makes it possible to reset the light amount Qm for the optical sensor 15 to a value in the normal range in a short length of time, thereby making it possible to read the control toner image on the intermediary transfer belt 9. Therefore, the image forming apparatus becomes stable in image quality.

Incidentally, the substances which adhere to the intermediary transfer belt 9 are not limited to the external additives. In reality, there are many substances which adhere to the intermediary transfer belt 9.

Figure 10:
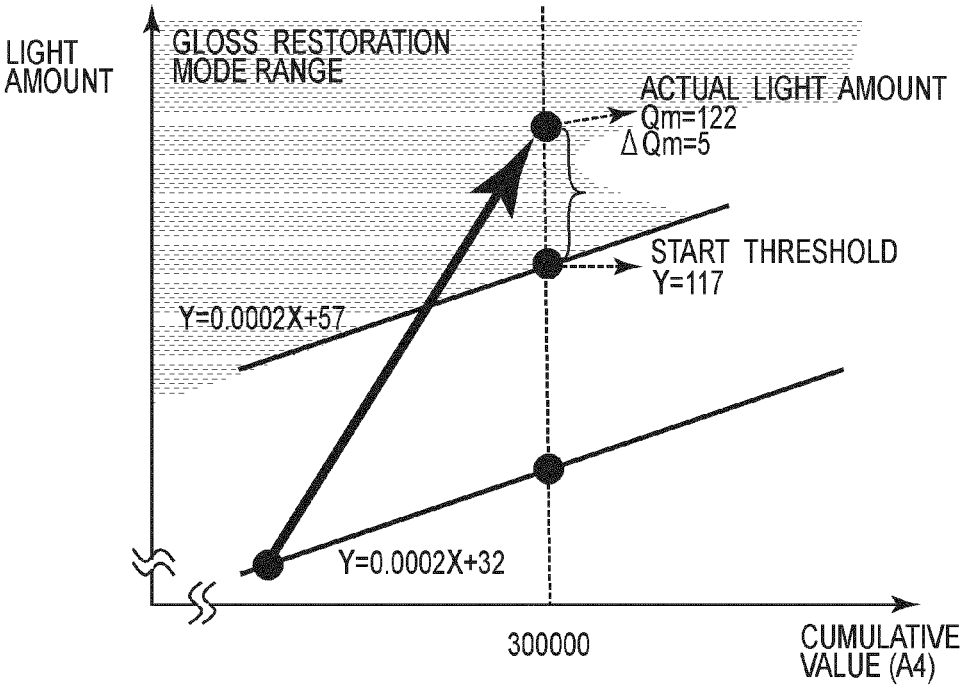
FIG. 10 is a graph for describing the point in time at which the image forming apparatus begins to be operated in the glossiness restoration mode, according to the first preferred embodiment.
Figure 11:
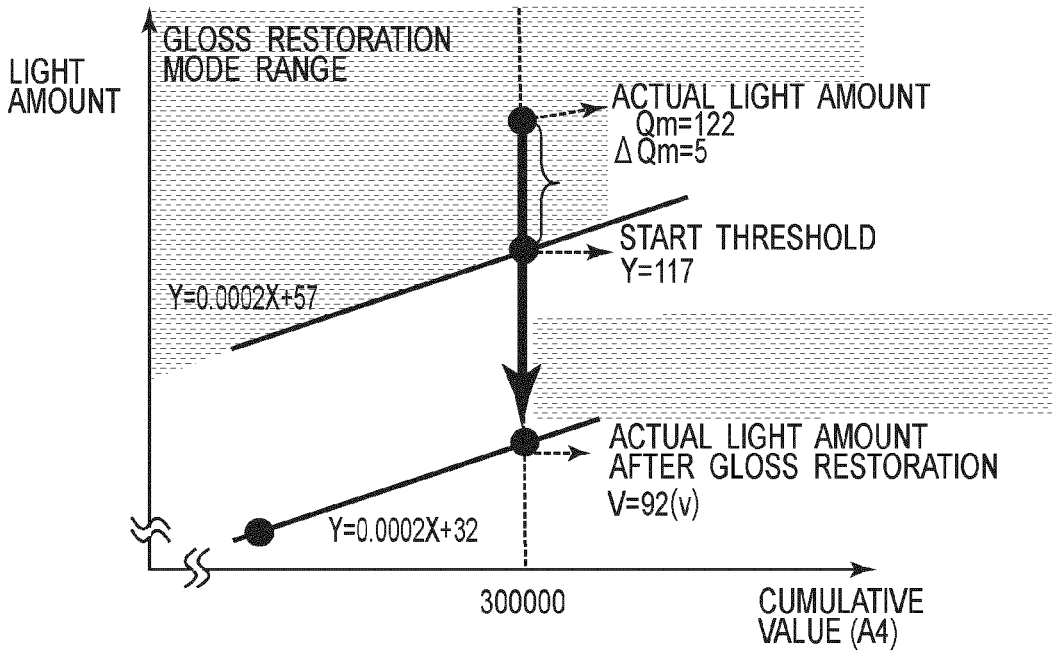
FIG. 11 is a graph for describing the point at which the image forming apparatus operation in the glossiness restoration mode is ended.

FIG. 10 is a graph for describing the point in time at which the image forming apparatus begins to be operated in the glossiness restoration mode, in the first embodiment of the present invention, and FIG. 11 is a graph for describing the point in time at which the operation of the image forming apparatus in the glossiness restoration mode is ended. Referring to FIGS. 2 and 10, the value to which the light amount Qm of the optical sensor 15 was set was 122. When the cumulative number X of the images formed after the latest replacement of the intermediary transfer belt 9 was 300,000, the value y of the restoration threshold level, and the length Tk of time the image forming apparatus is to be operated in the glossiness restoration mode, can be calculated using the following Equations (1) and (2):

$$y=0.0002X+57=0.0002\times300000+57=117;\text{ and}$$

$$Tk=0.2\times\Delta Qm+5=0.2\times(122-117)+5=6.$$

Because the value 122 to which the light amount Qm was set is greater than the value 117 of the restoration threshold level, the control portion 110 puts the image forming apparatus on standby in terms of image formation, and starts operating the apparatus in the glossiness restoration mode. Then, it stopped operating the apparatus in the glossiness restoration mode after operating the apparatus in the glossiness restoration mode for 6 minutes (Tk=6).

Referring to FIG. 11, the value to which the light amount Qm was set for the optical sensor 15 after the operation of the image forming apparatus in the glossiness restoration mode was 92. That is, the light amount Qm was reduced to the value on the straight line which represents the normal change of the light amount Qm, and is defined by Equation (3):

$$Qm=0.0002X+32=0.0002\times300000+32=92.$$

Thus, it was possible for the optical sensor 15 to properly read the control toner image on the intermediary transfer belt 9. Therefore, it was guaranteed that the image forming apparatus forms images which are satisfactory in quality.

As will be evident from the description of the first embodiment of the present invention given above, not only can the first embodiment reduces the amount by which contaminants collects on the intermediary transfer belt 9 when the image bearing member (intermediary transfer belt 9) is relatively high in glossiness, that is, when the image bearing member is newer, but also, it can extend the image bearing member in service life. Thus, it can reduce the image forming apparatus in the frequency with which the apparatus must be operated in the cleaning mode, and the length of time the apparatus must be operated in the cleaning mode, reducing thereby the apparatus in the length of downtime in terms of actual image forming operation.

Embodiment 2

Figure 12:
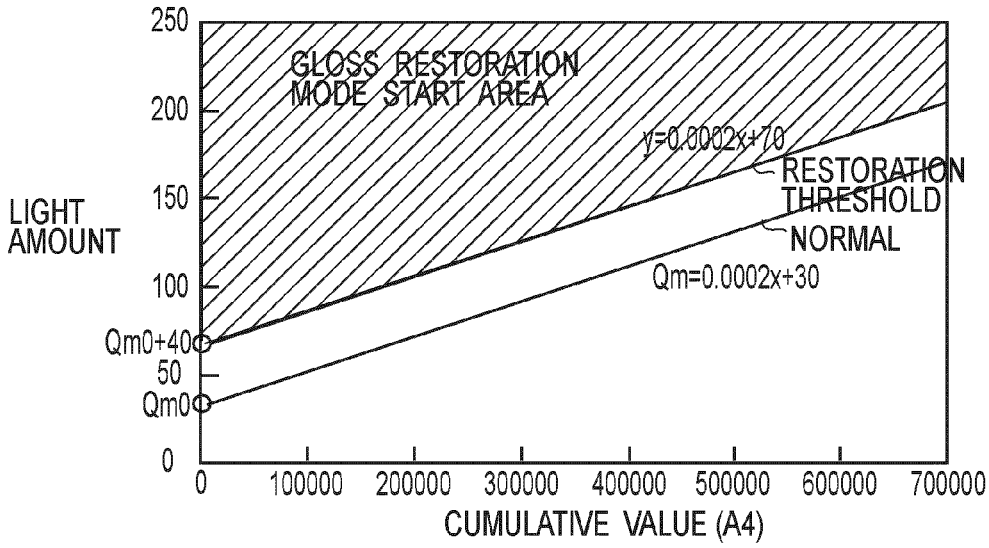
FIG. 12 is a graph for describing the glossiness restoration threshold for the glossiness restoration mode, according to a second preferred embodiment of the present invention.
Figure 13:
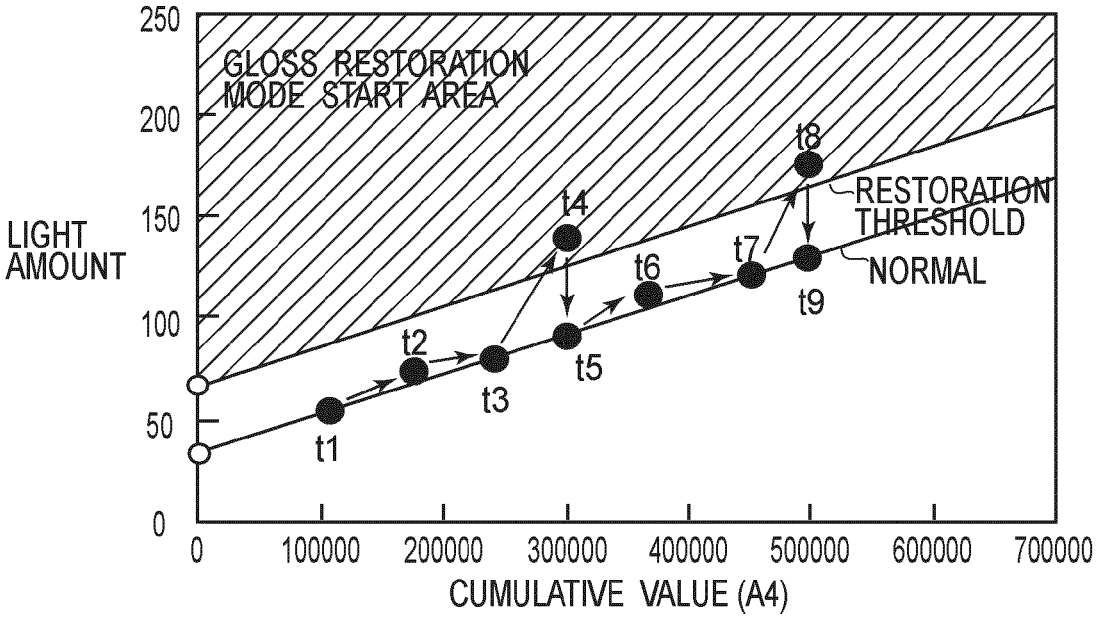
FIG. 13 is a graph for describing the changes which have to be made in the amount by which light is emitted by the LED of the optical sensor, according to the increase in the cumulative usage of the intermediary transfer belt.
Figure 14:
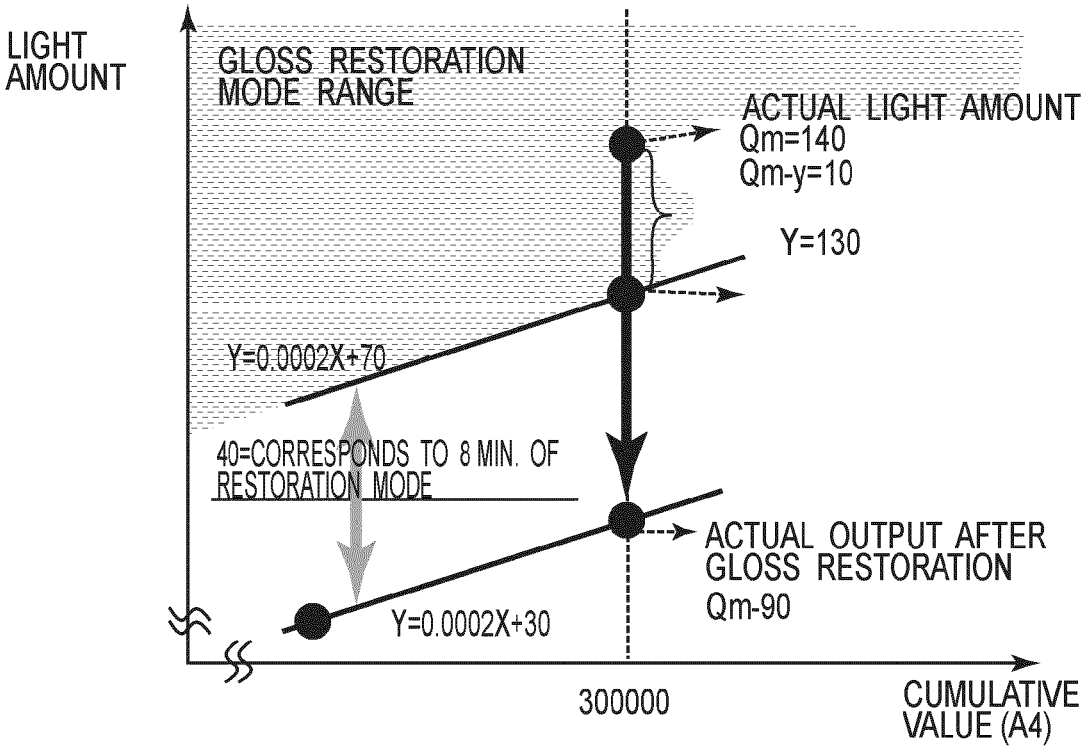
FIG. 14 is a graph for describing the changes in the amount by which light is emitted by the LED of the optical sensor, in the glossiness restoration mode, according to the second embodiment.

FIG. 12 is a graph for describing the restoration threshold level for the glossiness restoration mode in the second preferred embodiment of the present invention, and FIG. 13 is a graph for describing the changes in the light amount, which is attributable to the cumulative usage of the intermediary transfer belt. FIG. 14 is a graph for describing the change in the light amount for the detection sensor, which occurs while the image forming apparatus is operated in the glossiness restoration mode in the second embodiment.

Referring to FIG. 2, in the second preferred embodiment, the image forming apparatus 100 in the first preferred embodiment is controlled based on the flowchart in FIG. 6 while being operated in the glossiness restoration mode. The various conditions set for the glossiness restoration mode in this embodiment are the same as those described regarding the first embodiment, except that in this embodiment, the contact pressure between the intermediary transfer belt 9 and web-roller 44 is 45 N (4.5 kgf), which is higher than the normal contact pressure, which is 30 N (3.0 kgf). That is, in this embodiment, the contact pressure is increased to enhance the web-based cleaning apparatus 40 in cleaning performance.

Increasing the contact pressure of the web-roller 44 to 45 N (4.5 kgf) definitely enhances the web-based cleaning apparatus 40 in cleaning performance. However, it extremely increases the frictional load to which the cleaning web 45 is subjected. Thus, it changes the rotational speed of the intermediary transfer belt 9. If the contact pressure between the web-roller 44 and intermediary transfer belt 6 is 40 N (4.5 kgf) during the normal image forming operation, color deviation, banding, and/or the like problems occur. Thus, 45 N (4.5 kgf) of contact pressure cannot be used except for the glossiness restoration mode.

Referring to FIGS. 2 and 12, in this embodiment, the value y of the restoration threshold level is set based on the following equation (Equation (4)), in which X stands for the cumulative number of images formed after the latest replacement of intermediary transfer belt 9:

$$y=0.0002X+70 \quad (4).$$

The length Tk of time the image forming apparatus is to be operated in the glossiness restoration mode is set based on the value y of the recovery threshold level and the value of the light amount Qm, using the following equation (Equation (5)):

$$Tk=0.2\times(Qm-y)+8 \quad (5).$$

In the second embodiment, the value Qm0 of the light amount Qm set for the optical sensor 15 while the intermediary transfer belt 9 is relatively new is 30. Thus, the normal change of the light amount Qm can be predicted with the use of the following equation (Equation (6)):

$$Qm=0.0002X+30 \quad (6).$$

In the second embodiment, as long as the light amount Qm normally changes, the difference between the restoration threshold level and the light amount Qm is 40, which corresponds to 8 minutes (Tk) of the operation in the glossiness restoration mode. Thus, the minimum length of time required for the glossiness restoration mode is 8 minutes.

Referring to FIGS. 2 and 13, during a period of time t1-t3 in which the light amount Qm does not exceed the value y of the restoration threshold level, the image forming apparatus is not operated in the glossiness restoration mode. The value set for the light amount Qm at time t4 was greater than the value y of the restoration threshold level. Therefore, the image forming apparatus was operated in the glossiness restoration mode. The value set for the light amount Qm at time t5 after the end of the image forming apparatus operation in the glossiness restoration mode was low enough to be on the straight line which presents the normal change of the light amount Qm.

Thereafter, that is, during period t5-t7, the image forming apparatus was not operated in the glossiness restoration mode. Then, the apparatus was operated in the glossiness restoration mode at time t8 when the light amount Qm became greater than the value y of the restoration threshold level. The value to which the light amount Qm was set at time t9 after the end of the image forming apparatus operation in the glossiness restoration mode was low enough to be on the straight line which represents the normal change of the light amount Qm.

Referring to FIGS. 2 and 14, the shortest length Tk of time the image forming apparatus is to be operated in the glossiness restoration mode is 8 minutes, and the length of the rest of the time is determined based on the value of (Qm−y) as the light amount Qm is set to a value greater than the value y of the restoration threshold level.

When the cumulative number of the images formed was 300000, the value of the light amount Qm for the optical sensor 15 was 140. Thus, the value y of the restoration threshold level obtained using Equation (4) when the cumulative number of image formation was 0.0002×300000+70=130, and therefore, the value of (Qm−y) was 10. Thus, the length Tk of time the image forming apparatus was operated in the glossiness restoration mode was 10 minutes, which was obtained using the Equation (5): Tk=0.2×10+8=10. The breakdown of the 10 minutes is: it takes 2 minutes for the light amount Qm to recover to value 130 of the restoration threshold level, and 8 minutes for the light amount Qm to recover from the restoration threshold level of 130 to the normal value of 90 (Qm=0.0002X+30=90). Referring to FIG. 14, the value to which the light amount Qm for the optical sensor 15 was set after the completion of the image forming operation in the glossiness restoration mode had recovered to 90, which is on the straight line representing the normal change of the light amount Qm. Thus, the control toner image formed on the intermediary transfer belt 9 was properly read, and therefore, it was ensured that the image forming apparatus would remain satisfactory in image quality.

As described above, not only can this embodiment reduce the amount by which contaminants collects on the image bearing member while the image bearing member is relatively high in glossiness, for example, when it is relatively new, but also, it can extend the image bearing member in service life. Thus, it can reduce the image forming apparatus in the frequency with which the apparatus is operated in the cleaning mode, and the length of time the apparatus is operated in the cleaning mode, reducing thereby the apparatus in the length of downtime in terms of actual image forming operation.

Embodiment 3

In this embodiment, the control portion 110 warns a user of the remaining length of service life of an image bearing member, based on the light amount for the optical sensor. This embodiment is the same as the preceding embodiments except for the structure related to the control portion. Thus, the portions of the image forming apparatus, in this embodiment, which are similar to the counterparts of the image forming apparatuses in the preceding embodiments, will be not be described.

Figure 15:
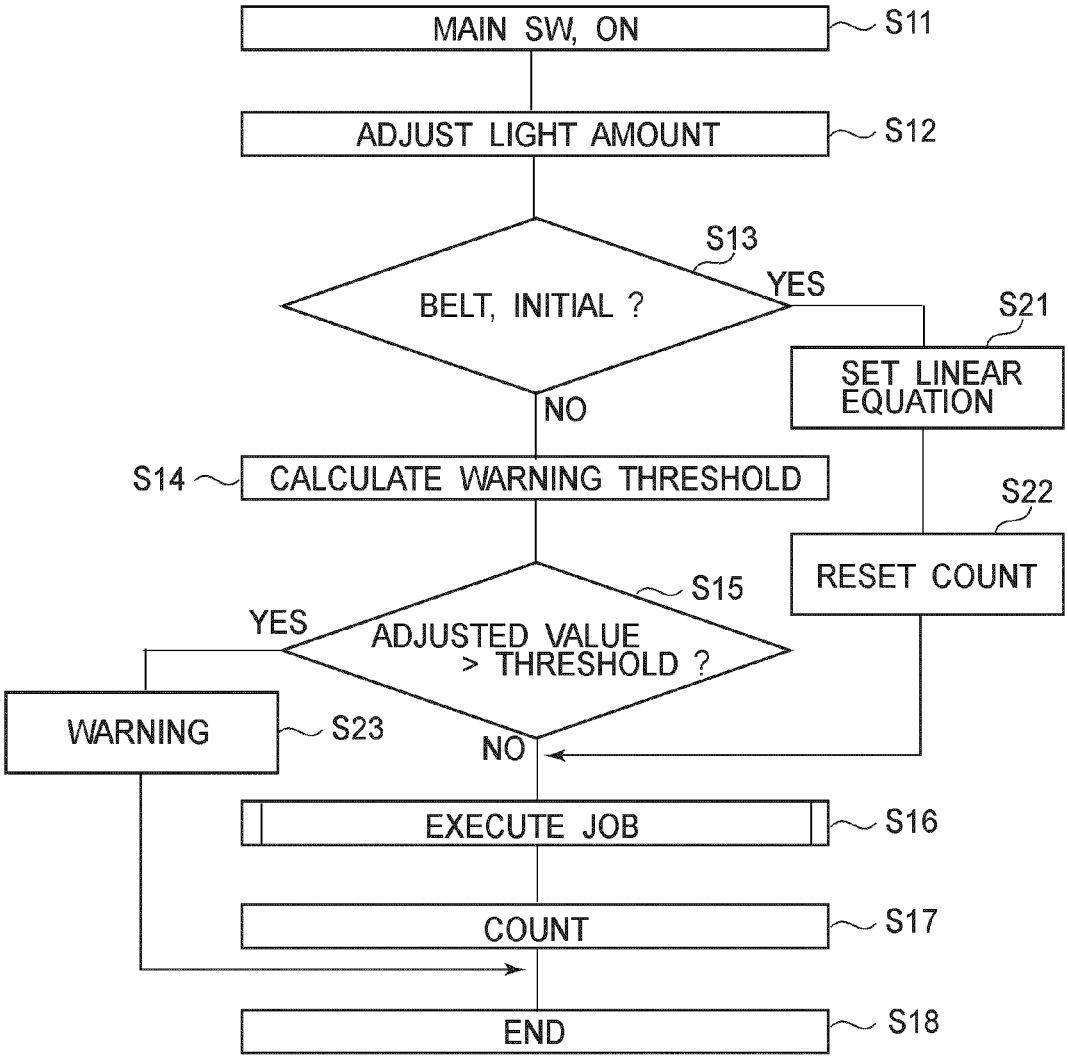
FIG. 15 is a flowchart of the control, in the third embodiment, for warning a user of the criticality of the intermediary transfer belt 9 in terms of glossiness.
Figure 16:
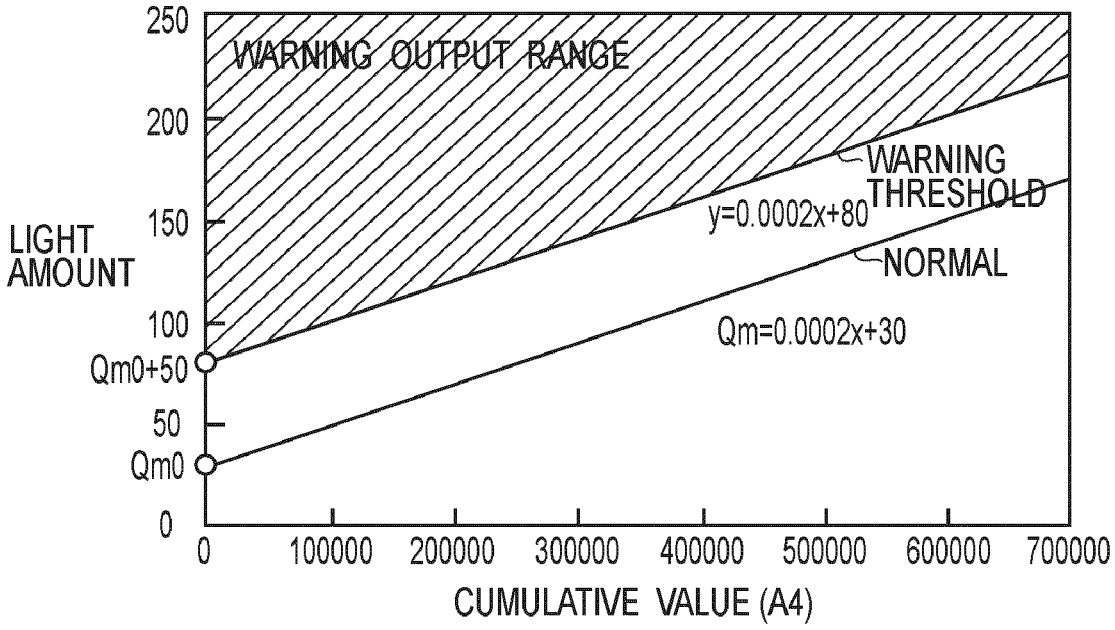
FIG. 16 is a graph for describing the linear equation, in the third embodiment, for calculating the threshold value for the amount by which light must be emitted by the LED, at which the warning regarding the intermediary transfer belt 9 should be issued.
Figure 17:
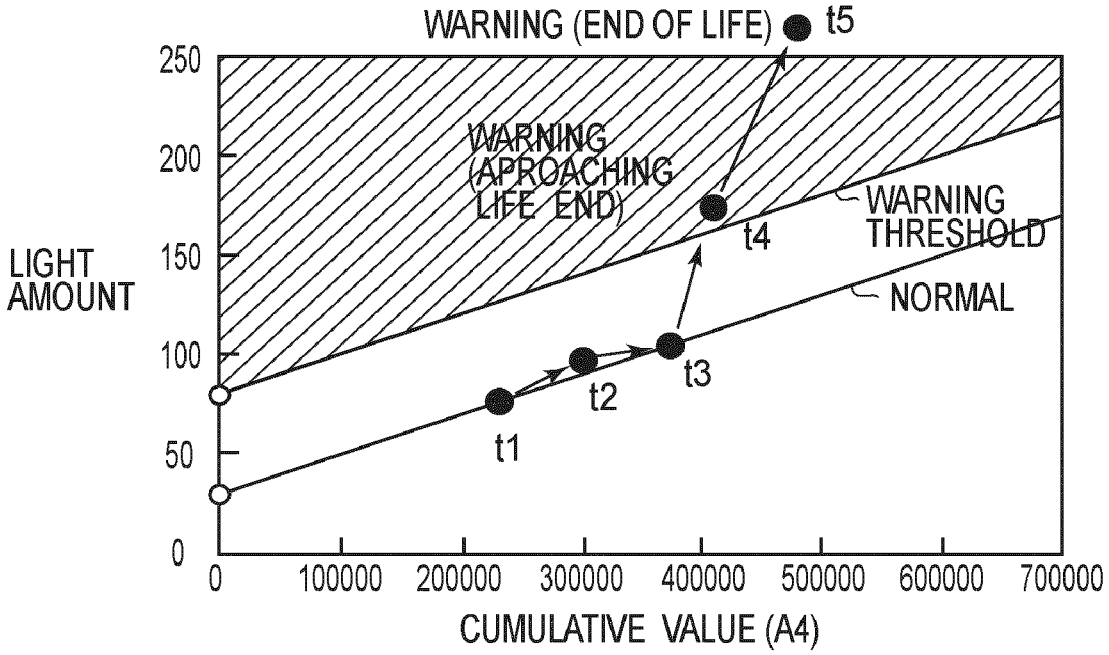
FIG. 17 is a graph for describing the relationship between the amount by which light is emitted by the LED, and the end-of-life warning regarding the intermediary transfer belt, according to a third preferred embodiment of the present invention.

FIG. 15 is a flowchart of the control sequence for warning a user of the criticality of the intermediary transfer belt 9 based on the glossiness level of the belt 9. FIG. 16 is a graph for describing the linear equation which defines the threshold level for warning issuance. FIG. 17 is a graph for describing the issuance of the warning for informing a user of the remaining length of the service life of the intermediary transfer belt, based on the light amount for the optical sensor 15.

In this embodiment, the image forming apparatus is provided with a display portion which displays the information regarding the image forming apparatus. Further, the control portion functions as the portion which outputs the information (warning) regarding the image bearing member.

Referring to FIGS. 2 and 15, as soon as the image forming apparatus 100 is turned on (S11), the control portion 110 variably sets the light amount Qm of the LED 15*e* of the optical sensor 15 (S12).

Then, when it is immediately after the replacement of the intermediary transfer belt 9 (YES in S13), the control portion 110 formulates a linear equation for calculating the threshold values for warning issuance, based on the latest value set for the light amount Qm (S21), and resets the counter for the cumulative number by which images are formed (S22).

Referring to FIGS. 2 and 16, when the initial value Qm0 of the light amount Qm for the optical sensor 15 while the intermediary transfer belt 9 is relatively new is 30/255, the threshold value for the warning issuance is the sum of the 30/255 and 50/255, that is, 80/255. Here, 50/255 is equivalent to 250000 in cumulative number of images formed with the use of the current intermediary transfer belt while the intermediary transfer belt 9 is reduced in reflectivity at the normal rate.

The equation for calculating the threshold value for warning issuance is formulated so that the threshold value for warning issuance is gradually increased from the initial value. The value y of the threshold level for warning issuance is set with the use of the following linear equation (1) so that it remains in the range in which the light amount Qm does not reach the upper limit of range in which the detection light amount Qm can be properly set, even if the intermediary transfer belt 9 reaches the end of its designed service life:

$$y=0.0002X+80 \quad (1).$$

When it is not immediately after the replacement of the intermediary transfer belt 9 (NO in S13), the control portion 110 computes the threshold value for warning issuance by substituting the cumulative number X (in Equation (1)) of the images formed after the latest replacement of the intermediary transfer belt 9 with the actual cumulative number (S14).

If the latest value to which the light amount Qm was set is greater than the threshold value y for warning issuance (YES in S15), the control portion 110 displays on the control panel 108 a message that warns a user of the arrival of the end of the expected service life of the intermediary transfer belt 9 (S23).

In other words, the control portion 110 does not issue the end-of-service life warming until the intermediary transfer belt 9 reduces in reflectivity from the value of the normal reduction in reflectivity, which corresponds to the current cumulative number of the image formed, to a value equivalent to 250000 in the cumulative number of images formed (light amount Qm changes by 50/255).

Unless the latest value to which the light amount Qm was set is greater than the threshold value y for warning issuance (NO in S15), the control portion 110 makes the image forming apparatus carry out the current job (S16), and counts up the cumulative number X by which images have been formed.

It has been known that as long as the light amount Qm normally changes corresponding to the increase in the cumulative number X of the images formed, the rate of the change is 0.0002/image:

$$Qm=0.0002X+30 \quad (2).$$

As the adhesion of the toner, external additives, etc., to the intermediary transfer belt 9 continues, the intermediary transfer belt 9 is gradually reduced in glossiness, and therefore, the amount by which the beam of light projected upon the intermediary transfer belt 9 is received by the light receiving element 15*f* after being regularly reflected by the intermediary transfer belt 9 gradually reduces. Thus, the amount Qm by which the LED 15*e* must emit light in order for the light receiving element 15*f* to receive the reflected light by the target level Lm, gradually increases.

As the light amount Qm eventually reaches 250/255, which is close to the upper limit value of the light amount signal setting range, it becomes highly impossible to accurately read the control toner image ST on the intermediary transfer belt 9 with the use of the optical sensor 15. Thus, as the light amount Qm reaches 250/255, the control portion 110 determines that the intermediary transfer belt 9 has reached the end of its expected optical life. Then, the control portion 110 prompts a user to replace the intermediary transfer belt 9, or operate the image forming apparatus in the glossiness restoration mode.

As long as the light amount Qm normally increases, that is, following Equation (2), the value of the light amount Qm does not reach 250/255 until the cumulative number X by which images will have been formed reaches 1,100,000, which is substantially larger than 700,000, which is the expected mechanical and functional life of the intermediary transfer belt 9.

Further, if the increases of the light amount Qm follows the changes of the warning issuance threshold level (y), which is calculable with the use of Equation (1), the light amount Qm does not reach 250/255 until the cumulative number X by which images will have been formed reaches 850,000, which is greater than the length of the expected mechanical and functional life of the intermediary transfer belt 9, which is 700,000 in terms of the cumulative number by which images are formable therewith.

Referring to FIGS. 2 and 17, the control portion 110 displays one of the following warning messages on the monitor of the control panel, as one of the following inequalities is satisfied, in which Qmn stands for the value of the light amount Qm when the cumulative number by which images will have been formed is n, and Yn stands for the value y of the warning issuance threshold level:

if $Qmn-Yn<0$, the control portion 110 displays the warning message regarding the expected length of the service life of the intermediary transfer belt;

if $Qmn-Yn\geqq 0$, the control portion 110 displays the warning message regarding the expected length of the service life of the intermediary transfer belt;

if $Yn\leqq Qmn\leqq 250$, the control portion 110 displays the message indicating that the intermediary transfer belt 9 is near the end of its expected service life; and if $Yn\geqq 250$, the control portion 110 displays a message indicating that the intermediary transfer belt 9 has reached the end of its expected service life, and makes it impossible for the image forming apparatus 100 to start forming an image.

Therefore, as long as the increase in the light amount Qm follows the changes of the warning issuance level (y), which is computable with the use of Equation (1), the image forming apparatus 100 can be continuously used without being interrupted by the downtime attributable to the control for replacing the intermediary transfer belt 9 or restoring the intermediary transfer belt 9 in glossiness. That is, in a case where an image forming apparatus is continuously operated to form images which is low in image ratio, or images higher in the ratio of monochromatic area, it is not interrupted by the downtime attributable to the control for replacing the intermediary transfer belt 9, or restoring the intermediary transfer belt 9 in glossiness.

On the other hand, if the light amount Qm exceeds the warning issuance threshold level due to the increases in the ratio of the prints which are higher in image ratio and/or the ratio of the prints, the entirety of which is covered with a full-color image, all that is necessary is to replace the intermediary transfer belt, or to execute such a control that the image forming apparatus is operated in the glossiness restoration mode with the lowest frequency necessary.

The fur brushes 31 and 34 of the electrostatic cleaning apparatus 30 are different in the polarity of the toner recovered by them. Therefore, the ratio between the amount by which the residual toner is removed from the intermediary transfer belt 9 by the fur brush 31, and the amount by which the residual toner is removed from the intermediary transfer belt 9 by the fur brush 34, is affected by what kind of image is formed. That is, in a case where images which are relatively high in density are formed, the negatively charged transfer residual toner is greater in amount than the positive transfer residual toner, and therefore, the fur brush 34, to which positive voltage is applied, is soiled more than the fur brush 31, to which a negative voltage is applied. On the other, in a case where images which are relatively low in density are formed, the positive residual transfer toner is greater in amount than the negatively charged residual toner, and therefore, the fur brush 31, to which the negative voltage is applied is more soiled than the fur brush 34, to which the positive voltage is applied.

That is, the amount by which the transfer residual toner is recovered is affected by the density of the images being formed, and so is the difference between the extent to which the fur brush 31 is soiled by the transfer residual toner and the extent to which the fur brush 34 is soiled by the transfer residual toner. Thus, as an image forming operation continues, the fur brushes 31 and 34 become different in electrical resistance value. Further, not all the fur brushes 31 and 34 are the same in electrical resistance, and some fur brushes 31 and 34 change in electrical resistance. Therefore, if the voltages to be applied to the fur brushes 31 and 34 are kept at the initial levels, the voltages become improper for the fur brushes 31 and 34 to remove the transfer residual toner particles, making it possible that the intermediary transfer belt 9 will fail to be satisfactorily cleaned.

Further, if the voltages applied to the fur brushes 31 and 34 are lower than the proper voltages, the fur brushes 31 and 34 are weaker in the force for keeping the transfer residual toner confined therein, making it possible that the transfer residual toner in the fur brushes 31 and 34 will be thrown from the fur brushes 31 and 34 by the centrifugal force, or as the fur brushes 31 and 34 are rubbed by the intermediary transfer belt 9.

Further, if the voltages applied to the fur brushes 31 and 34 are higher than the proper voltage, electrical charge is injected into the toner recovered into the fur brushes 31 and 34, or by the electrical discharge caused by the excessive amount of voltage. If the transfer residual toner particles are injected with additional electric charge, it is possible that they will reverse in the polarity of their charge, and therefore, the residual toner particles will be spitted out of the fur brushes 31 and 34.

If a large amount of toner is thrown from the fur brushes 31 and 34 all at once, a large amount of the combination of the toner and external additives collects on the cleaning web of the web-based cleaning apparatus 40 which is on the downstream side of the electrostatic cleaning apparatus 30. As a result, the cleaning web 45 plays the opposite role from the role assigned to the cleaning web 45; it coats the intermediary transfer belt 9 with the toner and external additive as it rubs the intermediary transfer belt 9. Thus, if a large amount of toner is thrown from the fur brushes 31 and 34 all at once, it sometimes occurs that the intermediary transfer belt 9 suddenly reduces in glossiness. In this situation, the light amount Qm necessary for the light receiving element 15*f* to receive by a preset amount the beam of light reflected by the intermediary transfer belt 9, suddenly increases, for example, at points in time t3, t4, and t5 in FIG. 7.

If the value of the light amount Qm reaches and remains at the upper limit, the optical sensor 15 loses its image reproducing ability necessary to read the control toner image ST, and therefore, fails to properly detect and/or measure the control toner image ST.

The substances which adhere to the intermediary transfer belt 9 are not limited to the transfer residual toner and external additives. That is, the present invention relates to any substance as long as it is capable of adhering to the intermediary transfer belt 9.

Figure 18:
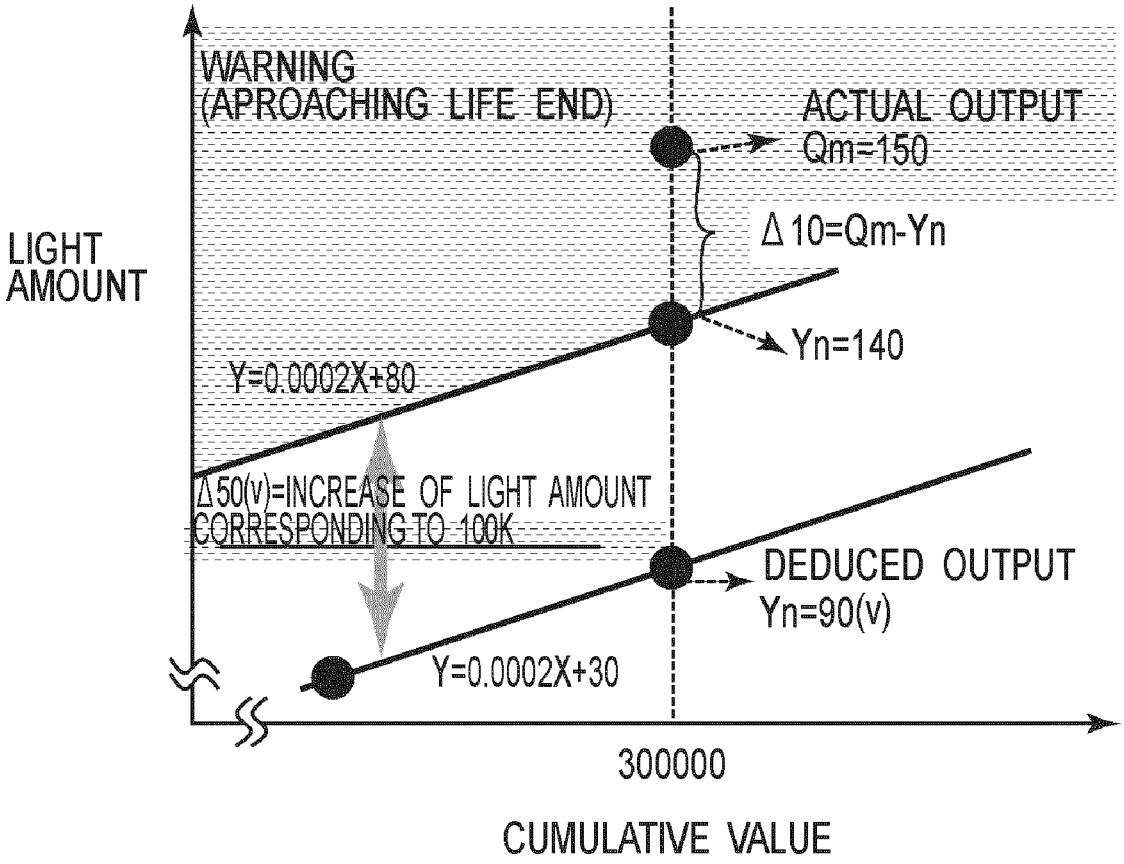
FIG. 18 is a graph for describing the control according to the third embodiment.

FIG. 18 is a graph for describing the control in the third embodiment.

Referring to FIGS. 2 and 18, when the cumulative number X by which images were formed by the image forming apparatus was 300,000, the value of the light amount Qm for the optical sensor 15 was 150. The value y of the warning issuance threshold level is obtained with the use of Equation (1) given below:

$$Yn=0.0002\times300000+80=140,$$

Thus, $Qmn-Yn=10\geqq0$.

This indicates that compared to the case in which the light amount Qm equally changed as the warning issuance threshold level (y), which is expressed by Equation (1), the light amount Qm is greater by an amount equivalent to the formation of 50,000 images. Further, in consideration of the increases of the light amount Qm, which is equivalent to 250,000 images, from the normal changes which is expressed by Equation (2), this indicates that the intermediary transfer belt 9 will be reduced in its expected service life by the amount equivalent to the formation of 300,000 images.

Thus, the control portion 110 transmits the information that the intermediary transfer belt 9 has been reduced in the expected service life by the amount equivalent to the formation of 300,000 images, to the host computer of the service station, through the communication network, with the use of its network communication function with which the image forming apparatus 100 is provided.

Therefore, a service person in the service station can immediately know the information regarding the expected length of the service life of the intermediary transfer belt 9, being enabled to quickly take proper actions for restoring the image forming apparatus 100 in function. Incidentally, in the preceding embodiments of the present invention, the image forming apparatuses were structured to enable the optical sensor to adjust the amount by which the light projected from the optical sensor, so that the light projected from the optical sensor is received by a preset amount by the optical sensor after being reflected by the image bearing member. In other words, it was checked whether or not the amount of the adjusted light reached the referential value. However, the same effects as those described above can be obtained by structuring the image forming apparatus so that a preset amount of light is projected upon the image bearing member, and it is checked whether or not the amount of the portion of the projected light, which is reflected by the image bearing member, is no more than the reference value.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 125621/2008 and 125622/2008 filed May 13, 2008 and May 13, 2008, respectively which are hereby incorporated by reference.

What is claimed is:

1. An image forming apparatus comprising:

an image bearing member for bearing a toner image;

toner image forming means for forming a toner image on said image bearing member;

a detecting member for directing light to an object and for detecting the light reflected by the object;

a controller for controlling a toner image forming condition of said toner image forming means in accordance with an output of said detecting member with respect to the toner image formed on said image bearing member and an output of said detecting member with respect to said image bearing member;

a cleaning member, in contact with said image bearing member, for cleaning said image bearing member;

an executing portion for executing, when the output with respect to said image bearing member reaches a reference level, an operation in a cleaning mode in which said cleaning member cleans said image bearing member; and a change portion for changing the reference level in accordance with an amount of use of said image bearing member.

2. An apparatus according to claim 1, wherein said detecting member changes an amount of the light directed to said image bearing member such that a predetermined amount of light is reflected by said image bearing member, and the reference level is related to an amount of the light directed to said image bearing member.

3. An apparatus according to claim 2, wherein said change portion decreases the reference level when the amount of use of said image bearing member is small, and said change portion increases the reference level when the amount of use of said image bearing member is large.

4. An apparatus according to claim 2, wherein when said image bearing member is replaced with another image bearing member, said reference level is set to an initial value which is determined in accordance with an output of said detecting member with respect to said another image bearing member, and is increased with an amount of use of said image bearing member.

5. An apparatus according to claim 2, wherein the reference value at the time of an end of the operation in the cleaning mode increases with the amount of use of said image bearing member.

6. An apparatus according to claim 2, wherein an ending reference level indicating an end of an operation in the cleaning mode increases with a difference between an output of said detecting member when the operation in the cleaning mode starts and the ending reference level.

7. An apparatus according to claim 1, wherein said cleaning member includes an electrostatic cleaning member for electrostatically removing untransferred toner remaining on said image bearing member and a cleaning web for rubbing said image bearing member at a position after said electrostatic cleaning member, wherein a cleaning power of said cleaning web is enhanced in the cleaning mode.

8. An image forming apparatus comprising:

an image bearing member for bearing a toner image;

toner image forming means for forming a toner image on said image bearing member;

a detecting member for directing light to an object and for detecting the light reflected by the object;

a controller for controlling a toner image forming condition of said toner image forming means in accordance with an output of said detecting member with respect to the toner image formed on said image bearing member and an output of said detecting member with respect to said image bearing member;

an output portion for outputting information relating to said image bearing member when the output of said detecting member with respect to said image bearing member reaches a reference level; and a change portion for changing the reference level in accordance with an amount of use of said image bearing member.

9. An apparatus according to claim 8, wherein said detecting member changes an amount of the light directed to said image bearing member such that a predetermined amount of light is reflected by said image bearing member, and the reference level is related to an amount of the light directed to said image bearing member.

10. An apparatus according to claim 9, wherein said change portion decreases the reference level when the amount of use of said image bearing member is small, and said change portion increases the reference level when the amount of use of said image bearing member is large.

11. An apparatus according to claim 9, wherein when said image bearing member is replaced with another image bearing member, said reference level is set to an initial value which is determined in accordance with an output of said detecting member with respect to said another image bearing member, and is increased with use of said another image bearing member.

12. An apparatus according to claim 8, wherein when the output approaches a first upper limit a warning output is produced, and when the output reaches a second upper limit a different warning output is produced.

13. An apparatus according to claim 8, further comprising a display portion for displaying information relating to said image forming apparatus, wherein said output portion outputs the information relating to said image bearing member to said display portion.

* * * * *